US008579641B1

(12) United States Patent
Queru

(10) Patent No.: US 8,579,641 B1
(45) Date of Patent: Nov. 12, 2013

(54) MULTI-ORIENTATION PLUG

(75) Inventor: Jean Baptiste Maurice Queru, Foster City, CA (US)

(73) Assignee: Google Inc., Mountain View, CA (US)

( * ) Notice: Subject to any disclaimer, the term of this patent is extended or adjusted under 35 U.S.C. 154(b) by 62 days.

(21) Appl. No.: 13/345,911

(22) Filed: Jan. 9, 2012

Related U.S. Application Data

(60) Provisional application No. 61/452,274, filed on Mar. 14, 2011.

(51) Int. Cl.
*H01R 33/00* (2006.01)

(52) U.S. Cl.
USPC ..... 439/224

(58) Field of Classification Search
USPC ..... 439/224, 218, 221
See application file for complete search history.

(56) References Cited

U.S. PATENT DOCUMENTS

| | | | | |
|---|---|---|---|---|
| 1,870,762 | A * | 8/1932 | Winter | 200/51.05 |
| 2,922,054 | A * | 1/1960 | Maurice Miller | 310/71 |
| 3,139,492 | A * | 6/1964 | Cage, Jr. | 200/11 R |
| 3,523,269 | A | 8/1970 | Witek, Jr. et al. | |
| RE31,017 | E | 8/1982 | Bernstein | |
| 4,379,606 | A | 4/1983 | Clark et al. | |
| 4,457,570 | A | 7/1984 | Bogese, II | |
| 4,566,749 | A | 1/1986 | Johnston | |
| 4,648,682 | A | 3/1987 | Tubbs | |
| 4,759,726 | A | 7/1988 | Naylor et al. | |
| 4,873,479 | A | 10/1989 | Iimura et al. | |
| 4,978,317 | A | 12/1990 | Pocrass | |
| 5,061,203 | A | 10/1991 | Allgood et al. | |
| 5,501,608 | A | 3/1996 | Scheer et al. | |
| 5,605,473 | A | 2/1997 | Kishon | |
| 5,626,488 | A | 5/1997 | Albeck et al. | |
| 5,876,237 | A | 3/1999 | Patel et al. | |
| 5,975,940 | A | 11/1999 | Hartmann et al. | |
| 6,027,365 | A | 2/2000 | Kaufman | |
| 6,086,395 | A | 7/2000 | Lloyd et al. | |
| 6,116,963 | A | 9/2000 | Shutter | |
| 6,141,212 | A * | 10/2000 | Fletcher et al. | 361/679.45 |
| 6,183,306 | B1 | 2/2001 | Caveney | |
| 6,190,190 | B1 | 2/2001 | Daly et al. | |
| 6,193,560 | B1 | 2/2001 | Morana et al. | |
| 6,210,236 | B1 | 4/2001 | Kan | |
| 6,261,120 | B1 | 7/2001 | Beege et al. | |
| 6,290,538 | B1 | 9/2001 | Pocrass | |

(Continued)

FOREIGN PATENT DOCUMENTS

| | | |
|---|---|---|
| DE | 4332068 | 3/1994 |
| DE | 19528410 | 2/1996 |

(Continued)

*Primary Examiner* — Gary F. Paumen
(74) *Attorney, Agent, or Firm* — Morris & Kamlay LLP

(57) ABSTRACT

An electrical adapter system includes a housing that includes a receiving portion, the housing including first electrical contacts and second electrical contacts disposed at the receiving portion. The electrical adapter system includes a plug that includes a body, electrical prongs extending from a surface of the body, and electrical contacts coupled to the electrical prongs. The body of the plug is receivable by the receiving portion in at least two orientations such that in each of the at least two orientations, the electrical prongs extend outward from the housing, and one or more of the electrical contacts of the plug engage at least one of the first electrical contacts or at least one of the second electrical contacts.

25 Claims, 21 Drawing Sheets

(56) References Cited

U.S. PATENT DOCUMENTS

| | | | | |
|---|---|---|---|---|
| 6,500,025 | B1 * | 12/2002 | Moenkhaus et al. | 439/502 |
| 6,520,787 | B1 * | 2/2003 | Lott | 439/218 |
| 6,558,203 | B2 | 5/2003 | Pocrass | |
| D478,310 | S | 8/2003 | Andre et al. | |
| 6,669,495 | B2 | 12/2003 | Philips et al. | |
| 6,749,451 | B2 * | 6/2004 | Schmitt | 439/218 |
| 6,756,543 | B1 | 6/2004 | Kaloustian | |
| 6,770,815 | B1 | 8/2004 | Shotey et al. | |
| 6,893,297 | B2 | 5/2005 | Chen | |
| 6,908,324 | B1 * | 6/2005 | Morley et al. | 439/218 |
| D519,922 | S | 5/2006 | Andre et al. | |
| 7,084,727 | B2 | 8/2006 | Bauer et al. | |
| 7,329,143 | B2 | 2/2008 | Schrader et al. | |
| 7,766,689 | B2 | 8/2010 | Knoerrchen et al. | |
| 7,789,686 | B2 * | 9/2010 | Kim | 439/218 |
| D638,356 | S | 5/2011 | Chen | |
| 2003/0076204 | A1 | 4/2003 | Whipple et al. | |
| 2004/0118620 | A1 | 6/2004 | Fringeli et al. | |
| 2004/0248457 | A1 | 12/2004 | Walter | |
| 2005/0000719 | A1 | 1/2005 | Shotey et al. | |
| 2005/0042929 | A1 | 2/2005 | Ng | |
| 2005/0270130 | A1 | 12/2005 | Roesner et al. | |
| 2007/0178747 | A1 | 8/2007 | Schrader | |
| 2009/0186493 | A1 * | 7/2009 | Daly et al. | 439/63 |
| 2009/0305565 | A1 | 12/2009 | Stiehl et al. | |
| 2009/0305578 | A1 | 12/2009 | Lim et al. | |
| 2010/0173514 | A1 | 7/2010 | Chiang et al. | |
| 2011/0028013 | A1 * | 2/2011 | Kim | 439/218 |
| 2011/0039435 | A1 * | 2/2011 | Huang | 439/218 |
| 2011/0225812 | A1 | 9/2011 | Deluliis et al. | |
| 2011/0227535 | A1 | 9/2011 | Caskey et al. | |

FOREIGN PATENT DOCUMENTS

| | | |
|---|---|---|
| DE | 19946568 | 4/2001 |
| DE | 10137497 | 5/2003 |
| DE | 10152347 | 6/2003 |
| DE | 10241198 | 8/2003 |
| DE | 10236790 | 10/2003 |
| DE | 102005023452 | 11/2006 |
| DE | 202006013824 | 10/2007 |
| EP | 0219570 | 4/1987 |
| EP | 0980124 | 2/2000 |

* cited by examiner

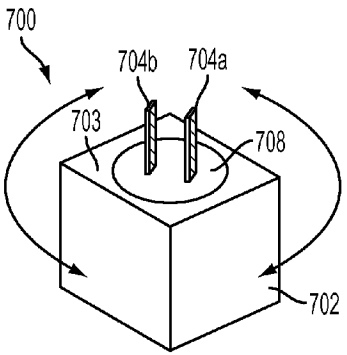
FIG. 13A
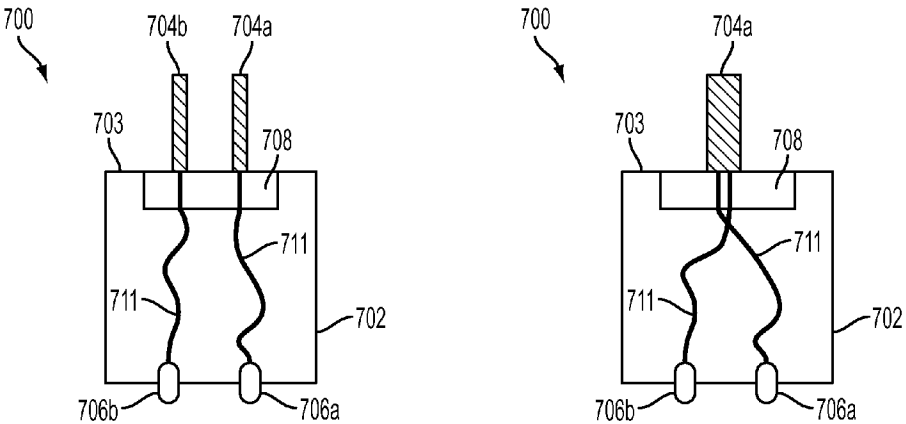
FIG. 13B
FIG. 13C
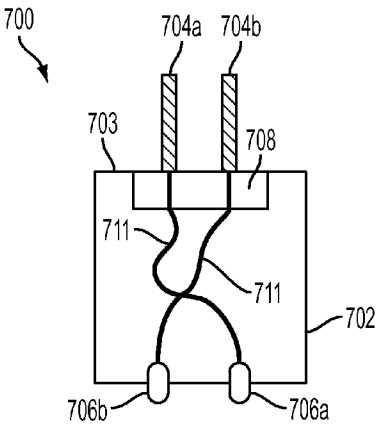
FIG. 13D

MULTI-ORIENTATION PLUG

CROSS REFERENCE TO RELATED APPLICATION

This application claims priority to U.S. Provisional Application No. 61/452,274, filed on Mar. 14, 2011.

BACKGROUND

The present specification relates to power adapters.

Power adapters are commonly used to power a variety of electrical devices. For example, radios, phones, notebook computers, and other devices frequently receive power from a power adapter that connects to an electrical outlet. Although power adapters provide users the convenience to use their electrical devices and recharge batteries, many power adapters are awkward to use. In some instances, power adapters block unused electrical outlets or require large amounts of space around an electrical outlet.

SUMMARY

A removable plug can be connected to a power adapter in multiple orientations. A user can select the orientation of the plug relative to the power adapter housing so that the power adapter assembly fits in the space constraints of a particular electrical outlet. For example, the electrical prongs can extend from one side to connect to a wall outlet, and the electrical prongs can extend from a different side to connect to a socket of a power strip. As another example, in different orientations of the plug, the electrical prongs extend from the same side of the housing by have different rotational orientations.

In one general aspect, an electrical adapter system includes a housing including a receiving portion, the housing including first electrical contacts and second electrical contacts disposed at the receiving portion; and a plug including a body, electrical prongs extending from a surface of the body, and electrical contacts coupled to the electrical prongs, the body of the plug being receivable by the receiving portion in at least two orientations such that in each of the at least two orientations: the electrical prongs extend outward from the housing, and one or more of the electrical contacts of the plug engage at least one of the first electrical contacts or at least one of the second electrical contacts.

Implementations may optionally include one or more of the following features. For example, the first electrical contacts and the second electrical contacts include at least one shared electrical contact. The housing includes a first surface of the receiving portion and a second surface of the receiving portion, the second surface of the receiving portion being substantially orthogonal to the first surface of the receiving portion, and the first electrical contacts are disposed at the first surface of the receiving portion and the second electrical contacts are disposed at the second surface of the receiving portion. The receiving portion is configured to receive the body of the plug in a first orientation such that the electrical prongs extend substantially parallel to a first axis oriented substantially perpendicular to the first surface of the housing, and one or more of the electrical contacts of the plug engage one or more of the first electrical contacts of the housing, and the receiving portion is configured to receive the body of the plug in a second orientation such that the electrical prongs extend substantially parallel to a second axis substantially perpendicular to the second surface of the housing and one or more of the electrical contacts of the plug engage one or more of the second electrical contacts of the housing.

The receiving portion is configured to receive the body of the plug in a third orientation such that: the electrical prongs extend substantially parallel to the first axis and one or more of the electrical contacts of the plug engage one or more of the first electrical contacts of the housing; and the orientation of the body of the plug relative to the housing is rotationally offset by approximately 90 degrees relative to the orientation of the body of the plug relative to the housing in the first orientation. The body is substantially cube-shaped and the receiving portion is substantially cube-shaped. The receiving portion is located at a corner of the housing.

The receiving portion is configured to receive the plug in at least four orientations, and in each of the at least four orientations, one or more of the electrical contacts of the plug engage at least one of the first electrical contacts or at least one of the second electrical contacts. The receiving portion is configured to receive the plug in at least eight orientations, and in each of the at least eight orientations, one or more of the electrical contacts of the plug engage at least one of the first electrical contacts or at least one of the second electrical contacts. The housing further includes third electrical contacts disposed at the receiving portion, and the body of the plug is receivable by the receiving portion in at least three orientations.

The receiving portion is configured to receive the plug in a first orientation such that the electrical prongs extend in the direction of a first axis and one or more of the electrical contacts of the plug engage one or more of the first electrical contacts; the receiving portion is configured to receive the plug in a second orientation such that the electrical prongs extend in the direction of a second axis, the second axis being orthogonal to the first axis, and one or more of the electrical contacts of the plug engage one or more of the second electrical contacts; and the receiving portion is configured to receive the plug in a third orientation such that the electrical prongs extend in the direction of a third axis, the third axis being orthogonal to both the first axis and the second axis, and one or more of the electrical contacts of the plug engage one or more of the third electrical contacts.

The receiving portion is configured to receive the plug in at least six orientations such that in each of the at least six orientations, one or more of the electrical contacts of the plug engage at least one of the first electrical contacts, at least one of the second electrical contacts, or at least one of the third electrical contacts. The receiving portion is configured to receive the plug in at least twelve orientations such that in each of the at least twelve orientations, one or more of the electrical contacts of the plug engage at least one of the first electrical contacts, at least one of the second electrical contacts, or at least one of the third electrical contacts.

In another general aspect, a power adapter includes a housing that includes a receiving portion, the housing having a first surface disposed at the receiving portion and a second surface disposed at the receiving portion, the first surface being substantially orthogonal to the second surface; first electrical contacts including at least one contact disposed at the first surface; and second electrical contacts including at least one contact disposed at the second surface, where the housing is configured to receive a body of a plug in the receiving portion in at least two orientations such that in each of the at least two orientations, an electrically conductive connection is established between the plug and at least one of the first electrical contacts or at least one of the second electrical contacts.

Implementations may optionally include one or more of the following features. For example, the first electrical contacts and the second electrical contacts include at least one shared electrical contact. The first surface and the second surface extend inwardly from an exterior of the housing. Adapter circuitry is located in the housing, and the adapter circuitry is configured to receive electrical input from either or both of the first electrical contacts and the second electrical contacts, and one or more of the first electrical contacts and one or more of the second electrical contacts are connected such that voltages applied to the first electrical contacts are transmitted to the second electrical contacts, and voltages applied to the second electrical contacts are transmitted to the first electrical contacts. The first electrical contacts are recessed into the first surface and the second electrical contacts are recessed into the second surface. The first electrical contacts protrude from the first surface and the second electrical contacts protrude from the second surface. The receiving portion is cube-shaped and is defined at a corner of the housing. The housing has a third surface disposed at the receiving portion, the third surface being substantially orthogonal to the first surface and the second surface; the power adapter includes third electrical contacts disposed at the third surface; and the housing is configured to receive a body of a plug in the receiving portion in at least three orientations such that in each of the at least three orientations, an electrically conductive connection is established between the plug and at least one of the first electrical contacts, at least one of the second electrical contacts, or at least one of the third electrical contacts.

In another general aspect, an electrical plug includes a member having a first pair of substantially parallel sides, a second pair of substantially parallel sides, and a third pair of substantially parallel sides, the first, second, and third pairs of substantially parallel sides each being substantially orthogonal to the other two pairs of substantially parallel sides, and the first, second, and third pairs of substantially parallel sides each defining a portion of the outer surface of the member, the first pair of substantially parallel sides including a first side and a second side; electrical prongs coupled to the first side; and electrical contacts disposed at the second side and extending outward from the second side, the electrical contacts being coupled to the electrical prongs.

Implementations may optionally include one or more of the following features. For example, the member includes angled walls defining a channel in each of one or more sides orthogonal to the first side. The member defines one or more recesses in at least one of the second pair of substantially parallel sides or in at least one of the third pair of substantially parallel sides. A rotatable member disposed at the first side, the rotatable member being configured to rotate relative to the member, the electrical prongs being coupled to the rotatable member. A safety mechanism disposed between the electrical contacts and the electrical prongs.

Advantageous implementations can include one or more of the following features. An electrical plug can be coupled to a power adapter in at least two orientations. The plug can be coupled to the electrical adapter so that electrical prongs of the plug extend from different sides of the power adapter in different orientations. The plug can be coupled to the electrical adapter so that the electrical prongs can extend perpendicular to a single side in multiple orientations.

The details of one or more implementations of the invention are set forth in the accompanying drawings and the description below. Other features and advantages of the invention will become apparent from the description, the drawings, and the claims.

BRIEF DESCRIPTION OF THE DRAWINGS

FIG. 13A is perspective view of an electrical plug with a rotatable face.

FIGS. 13B to 13D are side cutaway views of the electrical plug of FIG. 13A illustrating various orientations of the rotatable face.

Like reference numbers and designations in the various drawings indicate like elements.

DETAILED DESCRIPTION

A power adapter receives a removable plug in at least two orientations. The various orientations of the plug permit a user to change the orientation of the plug relative to the power adapter. For example, in one orientation, the electrical prongs extend from a first side of the power adapter. In another orientation, the electrical prongs extend from a second side of the power adapter. A user can move the electrical plug from one orientation to another to permit the power adapter to make best use of the space around an electrical outlet. If the power adapter does not fit near an electrical outlet in one orientation, the user can move the electrical plug to another orientation to allow the power adapter to be plugged into the outlet. The user can also select an orientation that does not obscure nearby electrical outlets.

Figure 1A:
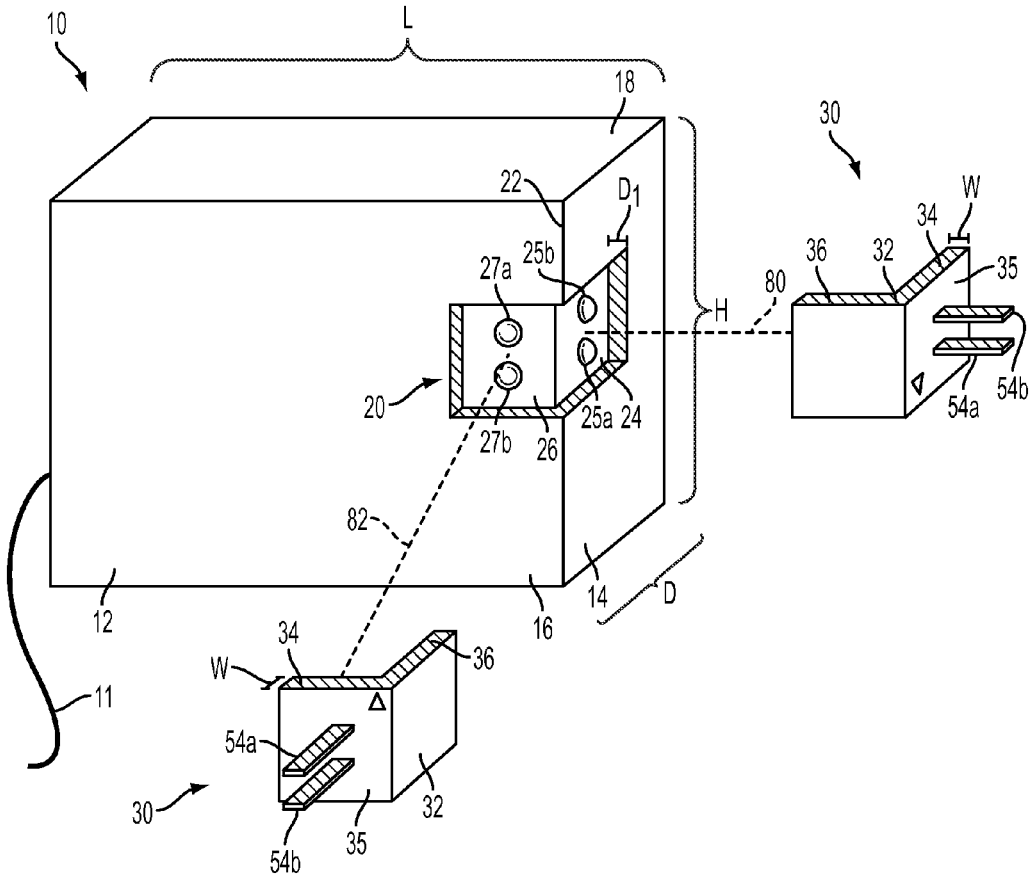
FIG. 1A is a perspective view of a power adapter and an electrical plug.
Figure 1B:
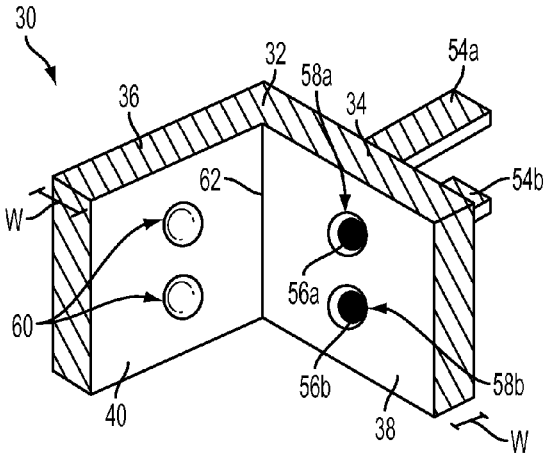
FIG. 1B is a perspective view of the electrical plug of FIG. 1A.

FIG. 1A is a perspective view of a power adapter 10 and an electrical plug 30. FIG. 1B is a perspective view of the electrical plug 30 of FIG. 1A. The power adapter 10 receives the plug 30 in at least two different orientations. In each of the orientations, an electrically conductive connection is established between the power adapter 10 and the plug 30. When coupled, the power adapter 10 and the electrical plug 30 form an electrical adapter assembly 90 (FIGS. 2A and 2B) that can be connected to an electrical outlet to supply power to an electrical device. As used herein, an electrical connection refers substantially to an electrically-conductive path established between two elements, whether or not current is flowing or a voltage is applied. The path can occur, for example, due to physical engagement of electrically-conductive elements or through intervening circuitry without direct engagement. In some implementations, an electrically-conductive path may include one or more connections that occur without direct physical engagement, for example, a connection through inductive coupling.

The power adapter 10 includes adapter circuitry (not shown), which can be located within a housing 12. The adapter circuitry can, for example, convert an alternating current (AC) input voltage to a direct current (DC) output voltage. An output cable 11 can be coupled to the power adapter 10 to provide power to an electrical device, such as a cellular phone, laptop computer, or media playing device.

The housing 12 can be formed in any suitable shape. In the illustrated example, the housing 12 includes substantially flat sides 14, 16, 18 oriented substantially perpendicular to each other such that the housing 12 has a block-like shape. Alternatively, the housing 12 can have rounded or contoured sides rather than flat sides.

The housing 12 can have a length, L, greater than the height, H, which is greater than the depth, D. Because the dimensions of the housing 12 can be unequal, different orientations of the housing 12 relative to a power outlet can have different clearance requirements. For example, when the first side 14 is oriented parallel to the face of an outlet (e.g., a vertical plane for a wall outlet), the length, L, of the power adapter 10 extends perpendicular to the face of the outlet. By contrast, when the second side 16 is oriented parallel to the face of an outlet, the depth, D, extends perpendicular to the face of the outlet. As a result, different orientations of the power adapter 10 relative to an outlet have different space requirements.

The housing 12 includes a receiving portion 20 in which to receive the plug 30. The receiving portion 20 is defined at an edge 22 of the housing 12 where the two perpendicular sides 14, 16 meet. The receiving portion 20 extends through a portion of both of the sides 14, 16, and is substantially symmetrical about the edge 22.

The shape and size of the receiving portion 20 are selected to approximate the shape and size of a body 32 of the plug 30. For example, the depth of the receiving portion $D_1$ is approximately equal to the width, W, of a first portion 34 and a second portion 36 of the body 32 of the plug 30. At each of the sides 14, 16, the receiving portion 20 has a shape that substantially matches the shape of the first portion 34 and the second portion 36 of the body 32 of the plug 30 (e.g., substantially rectangular or square), permitting the body 32 to be received in the receiving portion 20 (see FIGS. 2A and 2B). The receiving portion 20 can have other shapes and sizes depending on the geometry of the plug 30.

The receiving portion 20 of the housing 12 includes a first surface 24 disposed substantially parallel to the first side 14 and a second surface 26 oriented substantially parallel to the second side 16. The first surface 24 and the second surface 26 are substantially flat to engage a substantially flat first inner surface 38 and a substantially flat second inner surface 40 (FIG. 1B) of the body 32 of the plug 30. In some implementations, the first surface 24 and the second surface 26 can be contoured or angled to engage the inner surfaces 38, 40 of the body 32, which may not be flat or precisely perpendicular.

At the first surface 24, the power adapter 10 includes first electrical contacts 25*a*, 25*b*. At the second surface 26, the power adapter 10 includes second electrical contacts 27*a*, 27*b*. The first electrical contacts 25*a*, 25*b* and the second electrical contacts 27*a*, 27*b* can each include multiple contacts, for example, one contact for a phase (e.g., active or live AC) connection, and another contact for a return (e.g., neutral) connection. Additional contacts can be included, for example, to permit a connection to ground or to permit other electrical connections. The first electrical contacts 25*a*, 25*b* and the second electrical contacts 27*a*, 27*b* protrude from their respective surfaces 24, 26. When the plug 30 is detached from the power adapter 10, the power adapter 10 is not connected to AC power and contact with the exposed first electrical contacts 25*a*, 25*b* and second electrical contacts 27*a*, 27*b* is not dangerous. In some implementations, the first electrical contacts 25*a*, 25*b* and the second electrical contacts 27*a*, 27*b* can be flush with or can be recessed into the surfaces 24, 26.

The first electrical contacts 25*a*, 25*b* and the second electrical contacts 27*a*, 27*b* are coupled to the adapter circuitry, and are configured to receive AC power. The first electrical contacts 25*a*, 25*b* and second electrical contacts 27*a*, 27*b* can both be connected to the adapter circuitry such that electrical power applied to either the first electrical contacts 25*a*, 25*b* or the second electrical contacts 27*a*, 27*b* is transmitted to the adapter circuitry.

The first electrical contacts 25*a*, 25*b* and the second electrical contacts 27*a*, 27*b* are electrically connected to each other so that power applied to the first electrical contacts 25*a*, 25*b* is also applied to the second electrical contacts 27*a*, 27*b*, and vice versa. Thus an electrical connection to either the first electrical contacts 25*a*, 25*b* or the second electrical contacts 27*a*, 27*b* will supply power to the adapter circuitry. Alternatively, in some implementations, the first electrical contacts 25*a*, 25*b* and the second electrical contacts 27*a*, 27*b* can be electrically isolated from each other and still be coupled to the adapter circuitry.

The electrical plug 30 includes the body 32, electrical prongs 54*a*, 54*b*, and electrical contacts 56*a*, 56*b*. The body 52 includes the first portion 34 that extends from an edge 42 of the second portion 36. The first portion 34 extends substantially perpendicular to the second portion 36, such that the body 32 has a substantially L-shaped cross-section. The outer surface 35 of the first portion 34 and the outer surface 37 of the second portion 36 are substantially square, corresponding to the size of the receiving portion 20. The width, W, of the first portion 34 and the second portion 36 is substantially the same as the depth, $D_1$, of the receiving portion 20, so that the outer surfaces 35, 37 are flush with the sides 14, 16 of the housing 12 when the body 32 is received in the receiving portion 20.

The electrical prongs 54 extend from the outer surface 35 of the first portion 34 of the body 32. The electrical prongs 54 can extend substantially perpendicular to the surface 35. The electrical prongs 54 can include, for example, two or more prongs for insertion into an AC power outlet.

Referring to FIG. 1B, the plug 30 includes electrical contacts 56*a*, 56*b* at the first inner surface 38, opposite the electrical prongs 54. Each of the electrical contacts 56*a*, 56*b* is electrically connected to one of the electrical prongs 54*a*, 54*b* (for example, through a wire or conductor in the first portion 34), so that voltage applied to the electrical prongs 54 is transmitted to the electrical contacts 56*a*, 56*b*. Additionally, or alternatively, one or more electrical contacts can be located at the inner surface 40 and can be electrically connected to the electrical prongs 54*a*, 54*b*.

The electrical contacts 56*a*, 56*b* are disposed in recesses 58*a*, 58*b* in the first inner surface 38 of the first portion 34. The recesses 58*a*, 58*b* admit the first electrical contacts 25*a*, 25*b* or the second electrical contacts 27*a*, 27*b*, depending on the orientation of the plug 30 relative to the power adapter 10. The second portion 36 defines recesses 60 that admit the first electrical contacts 25*a*, 25*b* or the second electrical contacts 27*a*, 27*b* (again depending on the orientation of the plug 30 relative to the power adapter 10), but the recesses 60 do not include electrical contacts. The recesses 60 can be defined symmetrically relative to the recesses 58*a*, 58*b* across an inner edge 62 located between the first inner surface 38 and the second inner surface 40. For example, the recesses 60 can have reflectional symmetry across the inner edge 62 (such that the recesses 60 and the recesses 58*a*, 58*b* are mirror images of each other) or rotational symmetry (such that the position of the recesses 60 is rotationally offset relative to the position of the recesses 58*a*, 58*b* by, for example, 180 degrees), or both.

In addition, or alternatively, electrical contacts can be included in the recesses 60. In some implementations, electrical contacts can be located in each of the recesses 58*a*, 58*b*, 60. As a result, the power adapter 10 can include only one set of electrical contacts in the receiving portion 20 and still be able to establish an electrical connection (e.g., establish an electrically conductive path) with the plug 50 in multiple orientations.

Referring to FIGS. 1A and 1B, when the plug 30 is coupled to the power adapter 10, either the first electrical contacts 25*a*, 25*b* or the second electrical contacts 27*a*, 27*b* enter the recesses 58*a*, 58*b* and engage the electrical contacts 56*a*, 56*b*, establishing an electrically conductive connection. Whichever of the first electrical contacts 25*a*, 25*b* or the second electrical contacts 27*a*, 27*b* did not enter the recesses 58*a*, 58*b* enter the recesses 60. As a result, the electrical contacts 25*a*, 25*b*, 27*a*, 27*b*, which protrude from the surfaces 24, 26, will not impede the surfaces 24, 26 from resting against the inner surfaces 38, 40 of the plug 30.

In the example of FIGS. 1A and 1B, the first electrical contacts 25*a*, 25*b* are illustrated as being distinct and separate from the second electrical contacts 27*a*, 27*b*. In some implementations, the first electrical contacts 25*a*, 25*b* and the second electrical contacts 27*a*, 27*b* can include one or more shared contacts that are common to both sets. For example, a contact to connect to electrical ground can be included in both the first electrical contacts 25*a*, 25*b* and the second electrical contacts 27*a*, 27*b*, and the shared ground contact can engage a contact of the plug 30 in all orientations of the plug 30 relative to the housing 12. A shared contact of the first electrical contacts and second electrical contacts can engage different electrical contacts of the plug 30 in different orientations of the plug 30 and the housing 12 or can engage the same contact of the plug 30. The shared contact can engage a contact of the plug 30 in multiple orientations. In some implementations, a shared contact can be located at a corner, edge, or side of the receiving portion 20.

In some implementations, contacts of the first electrical contacts 25*a*, 25*b* or the second electrical contacts 27*a*, 27*b* can be spread over multiple surfaces of the receiving portion 20, rather than each being located at a single surface. Similarly, the electrical contacts 56*a*, 56*b* of the plug can be located on multiple surfaces of the plug 30, for example, on any of the surfaces facing or engaging the receiving portion 20.

Because the electrical contacts 56*a*, 56*b* are disposed within the recesses 58*a*, 58*b*, the possibility that a user accidently touches the electrical contacts 56*a*, 56*b* while the electrical prongs 54 are connected to AC power is less than if the electrical contacts 56*a*, 56*b* were flush with or protrude from the inner surface 38. The plug 30 can include one or more safety features that further limit accidental exposure to AC power, such as fuses, circuit breakers, switches, and current limiters. The plug 30 can also include one or more safety features that, for example, block the electrical contacts 56*a*, 56*b* from accidental exposure to a user. An example of a safety mechanism is described in greater detail with reference to FIGS. 5A and 5B.

The plug 30 can be coupled to the power adapter 10 in at least two orientations. Although the power adapter 10 receives only one plug 30 at a time, the plug 30 is shown in two positions in FIG. 1A to illustrate two different orientations.

Figure 2A:
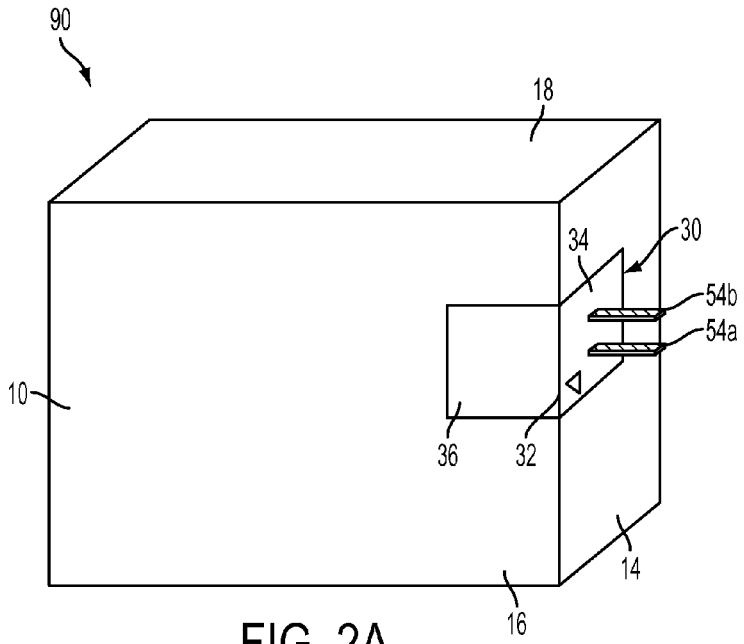
FIGS. 2A and 2B are perspective views of the electrical plug coupled to the power adapter in two different orientations.

In the first orientation, the electrical contacts 56*a*, 56*b* are aligned with the first electrical contacts 25*a*, 25*b*, for example, along a first axis 80. To couple the plug 30 to the power adapter 10 in the first orientation, the user moves the body 32 of the plug 30 into the receiving portion 20. The electrical contacts 56*a*, 56*b* engage the first electrical contacts 25*a*, 25*b* of the power adapter 10, forming an electrical connection that connects the electrical prongs 54*a*, 54*b* to the adapter circuitry through the first electrical contacts 25*a*, 25*b*. The second portion 36 of the body 32 covers the second electrical contacts 27*a*, 27*b*, which are received in the recesses 60. The electrical prongs 54*a*, 54*b* extend from the side 14 of the housing 12, as shown in FIG. 2A.

The plug 30 and the power adapter 10 form a power adapter assembly 90 that can be used to power electrical devices. The prongs 54*a*, 54*b* can be inserted into an electrical outlet so that the power adapter 10 provides power to one or more electrical devices. Because the second electrical contacts 27*a*, 27*b* are covered by the body 32 of the plug 30, the second electrical contacts 27*a*, 27*b* do not expose a user to AC power.

Figure 2B:
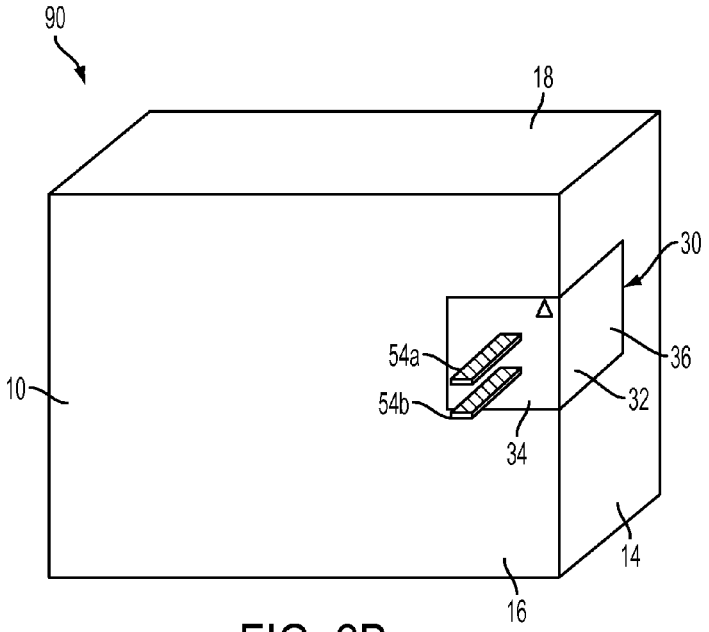

The plug 30 can be removed from the power adapter 10 and replaced in a second orientation relative to the power adapter 10. In the second orientation, the electrical contacts 56*a*, 56*b* of the plug 30 are aligned with the second electrical contacts 27*a*, 27*b*, for example, along a second axis 82. To couple the plug 30 to the power adapter 10 in the second orientation, the user moves the body 32 of the plug 30 into the receiving portion 20 so that the electrical contacts 56*a*, 56*b* engage the second electrical contacts 27*a*, 27*b* of the power adapter 10. This forms an electrical connection between the electrical prongs 54*a*, 54*b* and the adapter circuitry through the second electrical contacts 27*a*, 27*b*. In the second orientation, the second portion 36 of the body 32 covers the first electrical contacts 25*a*, 25*b*, and the electrical prongs 54*a*, 54*b* extend from the side 16 of the housing 12, as shown in FIG. 2B.

Because the electrical prongs 54*a*, 54*b* extend from different sides 14, 16 of the housing 12 during in the first and second orientations, the user can change the orientation of the plug 30 relative to the power adapter 10 to select the most advantageous orientation for a particular use. For example, in the first orientation, shown in FIG. 2A, the prongs 54*a*, 54*b* extend in a direction parallel to the length, L, of the housing 12. In the first orientation, for example, the power adapter assembly 90 can be used with a power strip in which multiple electrical outlets are arranged in a row. With the prongs 54*a*, 54*b* inserted in an outlet of a power strip, the length, L, of the housing extends upward so that the housing 12 does not obscure adjacent electrical outlets.

In the second orientation, the prongs 54*a*, 54*b* are oriented perpendicular to the side 16, the largest side of the power adapter 10. In the second orientation, the power adapter assembly 90 can be used at an electrical outlet in a wall. The housing 12 can extend parallel to the wall to avoid interfering with furniture or people passing by.

In addition, the power adapter 10 and the plug 30 maintain polarity during the first and the second orientations. Due to the arrangement of the first electrical contacts 25*a*, 25*b* and the second electrical contacts 27*a*, 27*b*, the adapter circuitry receives the same electrical input regardless of the orientation of the plug 30. For example, the contact 25*a* and the contact 27*a* are electrically connected, and the contact 25*b* and the contact 27*b* are electrically connected. The contact 25*b* is located above the contact 25*a* at the surface 24. By contrast, the position of the contacts 27*a*, 27*b* is reversed. Contact 27*a* is located above the contact 27*b* at the surface 26.

In the first orientation, the contact 56*a* connects to the contact 25*a*, and in the second orientation, the contact 56*a* connects to the contact 27*a*. Even though the orientation of the plug 30 changes between the first orientation and the second orientation, the same prong 54*a* will be connected to a particular input to the adapter circuitry (whether through contact 25*a* or contact 27*a*) in both the first orientation and the second orientation. Similarly, the prong 54*b* will connect to either the contact 25*b* or the contact 27*b* regardless of the orientation of the plug 30 to the power adapter 10, thus maintaining polarity of the input to the adapter circuitry.

FIGS. 3A to 3E are perspective views illustrating repositioning the electrical plug 30 from a first orientation (FIG. 3A) to a second orientation (FIG. 3E) relative to the power adapter 10. To change the orientation, the user first disconnects the power adapter assembly 90 from an AC power source.

From the first orientation, the user removes the plug 30 from the power adapter 10. In some implementations, the housing 12 defines a notch or groove that permits the user to pry the plug 30 out of the receiving portion 20. In other implementations, the power adapter 10 includes a release mechanism, such as a latch or a switch that releases a fastening mechanism that secures the plug 30 to the power adapter 10, allowing to the plug 30 to become uncoupled from the power adapter 10.

Figure 3A:
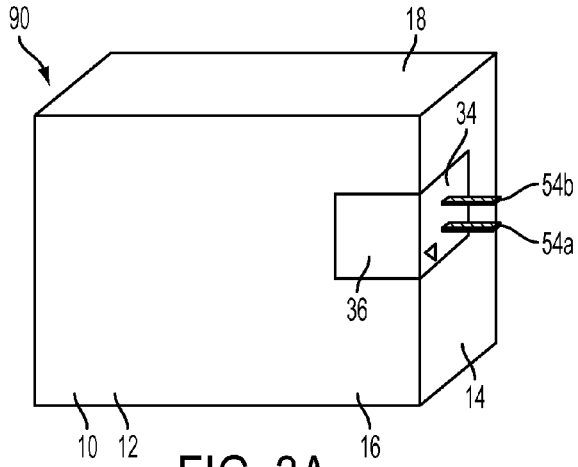
FIGS. 3A to 3E are perspective views illustrating repositioning the electrical plug from a first orientation to a second orientation relative to the power adapter.
Figure 3B:
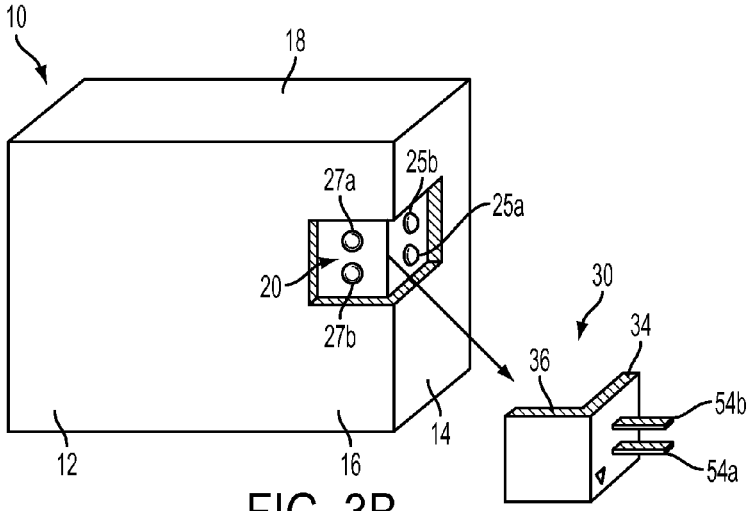
Figure 3C:
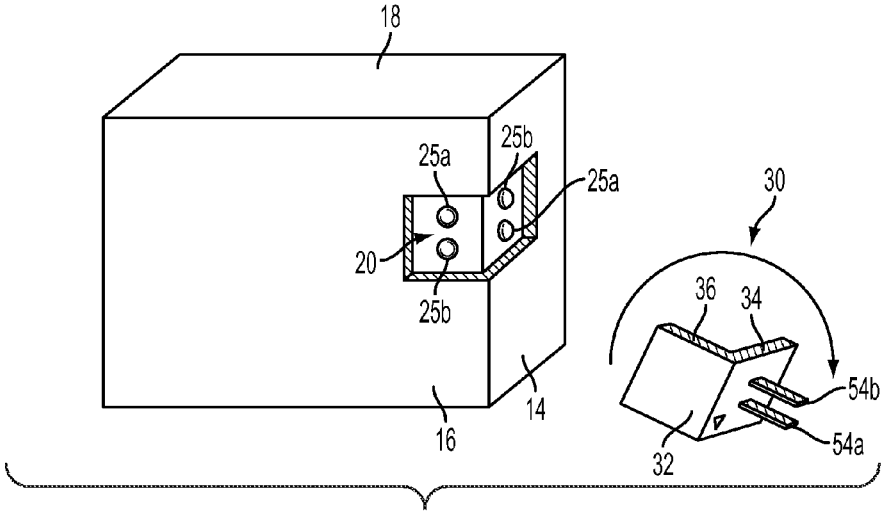
Figure 3D:
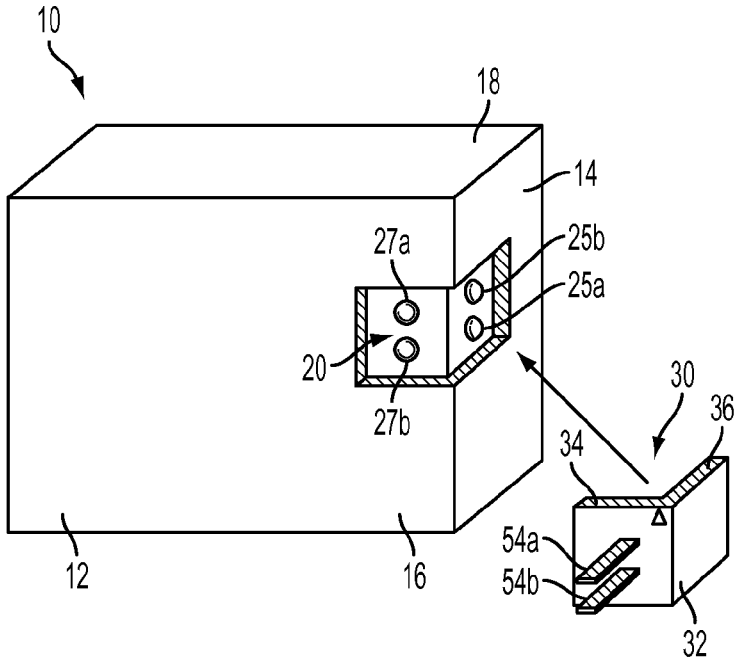
Figure 3E:
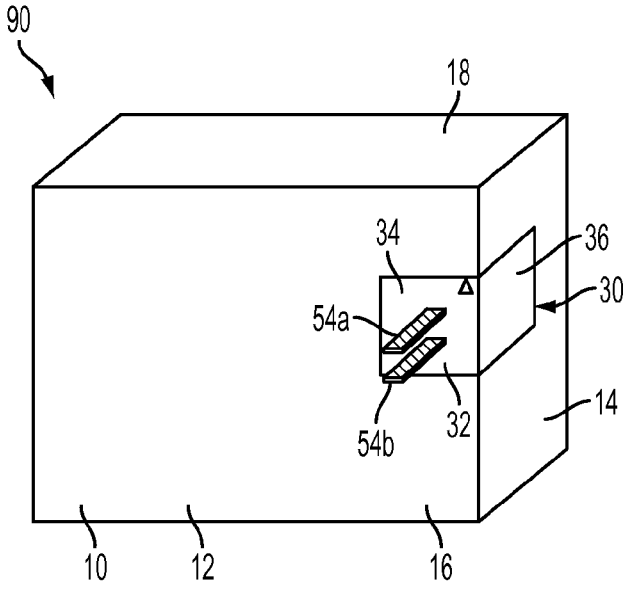

As shown in FIG. 3C, with the plug 30 uncoupled from the power adapter 10, the user rotates the plug 180 degrees. The user then couples the plug 30 to the power adapter 10 in the second orientation as shown in FIG. 3D. In some implementations, the plug 30 can be moved directly toward the edge 22 and placed in the receiving portion 20 to couple the plug 30 to the power adapter 10. In some implementations, the plug 30 slides along an axis (for example the first axis 80 or the second axis 82 of FIG. 1A) to be received in the receiving portion 20. The user presses the body 32 of the plug 30 into the receiving portion 20 to couple the plug 30 to the power adapter 10 in the second orientation, and the power adapter assembly 90 (FIG. 3E) can be connected to a power outlet to supply power to an electric device.

FIGS. 4A to 4F are cross-sectional views of various fastening mechanisms that can be used to couple an electrical plug to a power adapter. In some implementations, the engagement of the electrical contacts of a power adapter with recesses of the body of a plug can secure the plug to the power adapter. In addition, or alternatively, one or more fasteners such as rails, dovetail rails, tapers, clasps, clips, pins, straps, and snaps can secure a plug to a power adapter.

Figure 4A:
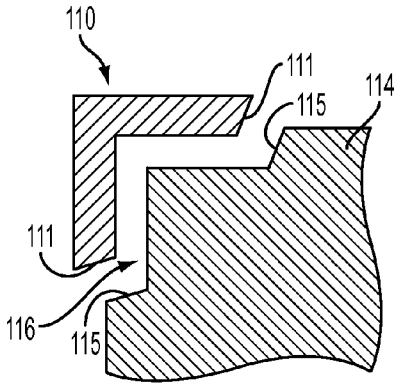
FIGS. 4A to 4F are cross-sectional views of various fastening mechanisms to couple an electrical plug to a power adapter.

Referring to FIG. 4A, a plug body 110 is coupled to a power adapter 114 by an interference fit (e.g., press fit). The body 110 includes tapered edges 111 that engage tapered edges 115 of the power adapter 114. As the body 110 is pressed into a receiving portion 116 in the power adapter 114, friction between the tapered edges 111, 115 holds the body 110 in place relative to the power adapter 114.

Figure 4B:
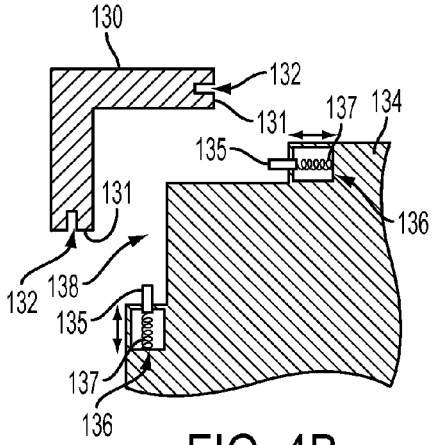

Referring to FIG. 4B, a plug body 130 is secured to a power adapter 134 by movable pins 135 in a receiving portion 138. The power adapter 134 includes pins 135 that move in a linear direction. Cavities 136 are defined in the power adapter 134, which allow the pins 135 to recede into the power adapter 134 when a force is applied against the pin 135. A spring 137 is coupled to each pin 135.

When the body 130 is brought toward the power adapter 134, ends 131 of the body 130 press the pins 135 into the cavities 136. This provides the body 130 clearance to move further into the receiving portion 138 while loading the springs 137. When the body 130 is received in the receiving portion 138, recesses 132 defined in the ends 131 of the body 130 align with the pins 135. The springs 137 cause the pins 135 to extend out of the cavities 136 and into the recesses 132. The pins 135, partially disposed in the recesses 132 and partially disposed in the power adapter 134, secure the body 130 to the power adapter 134. A sliding switch or other release mechanism (not shown) can be provided on the power adapter 134 to manually move the pins 135 into the power adapter 134, thus releasing the body 130.

Additional variations are also possible. For example, spring-loaded pins can be included in the body 130, and recesses to receive the pins can be included in the power adapter. Similarly, instead of pins, protruding edges can be received into channels. As another example, pins can be moved by other mechanisms other than springs. For example, a user can manipulate a control that causes pins to extend or retract from the power adapter 134 or from the body 130.

Figure 4C:
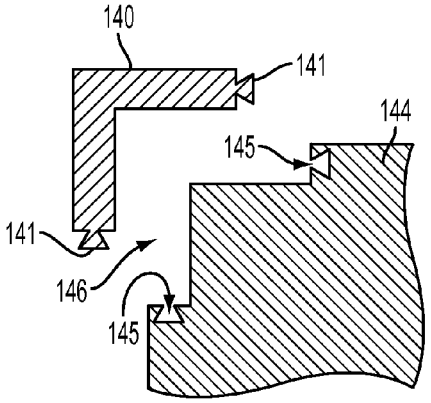
Figure 4D:
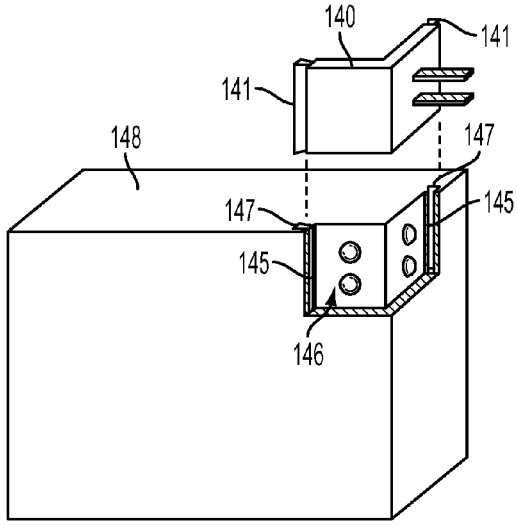

Referring to FIGS. 4C and 4D, a plug body 140 can include extensions 141, such as angled rails, that are received into channels 145 of a power adapter 144. The power adapter 144 defines entry points 147 that allow the extensions 141 to enter with the channels 145. For example, a receiving portion 146 that receives the body 140 can be defined through a surface 148 of the power adapter 144, permitting the extensions 141 to be placed in the channels 145 at the surface 148. The body 140 can slide into place, for example, in a linear motion, and the extensions 141 are received in the channels 145 to secure the body 140 to the power adapter 144.

Figure 4E:
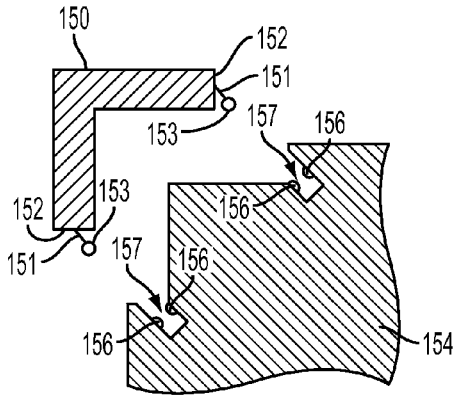

Referring to FIG. 4E, a plug body 150 includes extensions 151 disposed at approximately a 45 degree angle from end surfaces 152 of the body 150. The extensions 151 include a rounded end, such as a ball 153. The extensions 151 are received in sockets 155 defined in a power adapter 154. Each socket 155 includes one or more receiving members 156 that define an opening 157 slightly smaller than the width of the ball 153. As the body 150 is coupled to the power adapter 154, the balls 153 engage the receiving members 156, causing the receiving members 156 to flex or become displaced enough for the balls 153 to pass through. As the balls 153 pass between the receiving members 156, the receiving members 156 return to their original positions, narrowing the openings 157 to capture the balls 153 in the sockets 155. To remove the body 150 from the power adapter 154, the user can apply a force sufficient to flex or displace the receiving members 156 so that the balls 153 can leave the sockets 155, allowing the body 150 to become uncoupled from the power adapter 154.

Figure 4F:
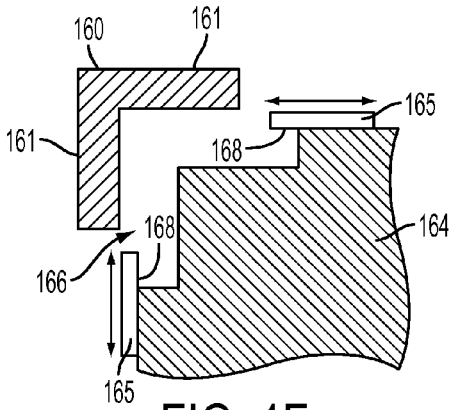

Referring to FIG. 4F, a plug body 160 is secured to a power adapter 164 by locks 165 that engage outer surfaces 161 of the body 160. The power adapter 164 defines a receiving portion 166 that receives the body 160. A user can move the locks 165 away from the receiving portion 166 to allow the body 160 to enter the receiving portion 166. For example, the locks 165 move in a linear direction parallel to sides 167 of the power adapter 164. In some implementations, the locks 165 can rotate, tilt, twist, recede into the power adapter 164, or otherwise move to allow the body 160 to enter the receiving portion 166. After the body 160 is received in the receiving portion 166, a user can move the locks 165 so that inner surfaces 168 of the locks 165 engage the outer surfaces 161 of the body 160, capturing the body 160 in the receiving portion 166. The locks 165 can be manually moved by the user, or can be moved in response to a user activating a control, such as a button or switch.

Figure 5B:
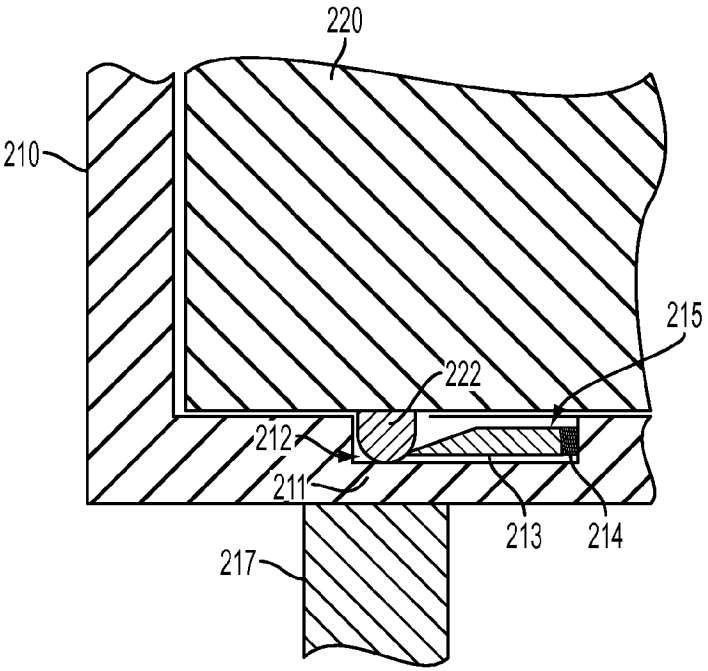
FIGS. 5A and 5B are cross-sectional views of a plug and a power adapter illustrating a safety mechanism.
Figure 5A:
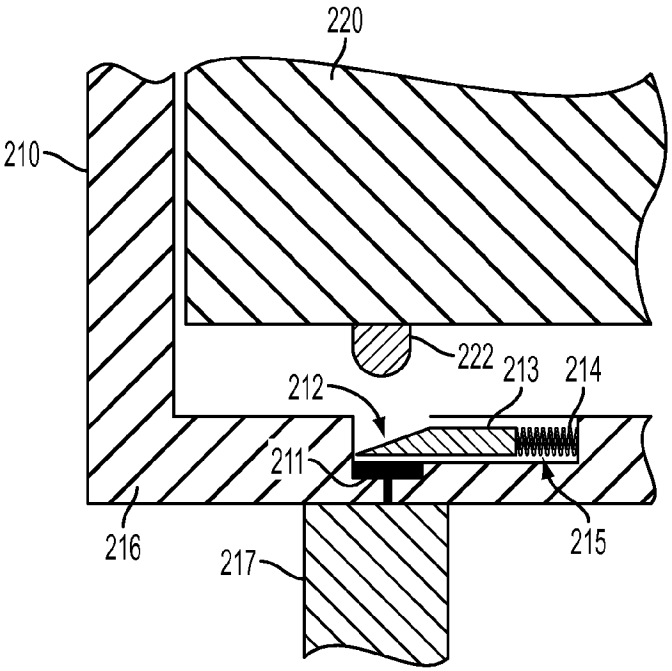

FIGS. 5A and 5B are cross-sectional views of a plug 210 and a power adapter 220 illustrating a safety mechanism. The safety mechanism includes a cover 213 that prevents accidental exposure to an electrical contact 211 of the plug 210 when the plug 210 is uncoupled from a power adapter 220.

The plug 210 includes a body 216 that defines a recess 212 and a compartment 215. The electrical contact 211 is disposed in the recess 212. The compartment 215 is open to the recess 212, so that the cover 213 can extend from the compartment 215 into the recess 212. The cover 213 covers the electrical contact 211 when the plug 210 is not coupled to the power adapter 220 (FIG. 5A), preventing a user from accidentally touching the electrical contact 211. A spring 214 presses the cover 213 into the recess 212.

When the plug 210 becomes coupled to the power adapter 220, an electrical contact 222 of the power adapter 220 enters the recess 212. The electrical contact 222 engages the cover 213 and moves the cover out of the recess 212 such that the cover 213 is received in the compartment 215. With the cover 213 moved out of the recess 212, the electrical contact 222 of the power adapter 220 can engage the electrical contact 211 of the plug 210 to establish an electrical connection with an electrical prong 217 of the plug 210. When the plug 210 is uncoupled from the power adapter 220, the spring 214 moves the cover 213 into the recess 212 to cover the electrical contact 211 of the plug 210.

Additional variations are possible. For example, the cover 213 can be retracted from the recess by mechanisms other than direct contact with the electrical contact 222. As another example, the electrical contacts located at different surfaces of a power adapter may not all be simultaneously connected to each other or to the adapter circuitry. As a result, AC power connected to electrical contacts at one surface of the power adapter may not expose AC power at electrical contacts located at different surface. If the body of the plug 210 breaks, some electrical contacts of the power adapter 220 (e.g., electrical contacts that are not positioned behind the electrical prongs) may become exposed. Nevertheless, when the exposed electrical contacts are not connected to the adapter circuitry, there is no danger to a user.

A power adapter 220 can include one or more switches that can connect electrical contacts of the power adapter 220 to and disconnect the electrical contacts from the adapter circuitry. For example, a pin extending from a surface of the plug 210 can engage a switch of the power adapter 220, causing the switch to connect a particular set of electrical contacts of the power adapter 220 to the adapter circuitry. Only the particular set of electrical contacts needed for the current orientation of the plug 210 can be connected to the adapter circuitry, while one or more other sets of electrical contacts of the power adapter 220 remain disconnected from the adapter circuitry for safety.

Figure 6A:
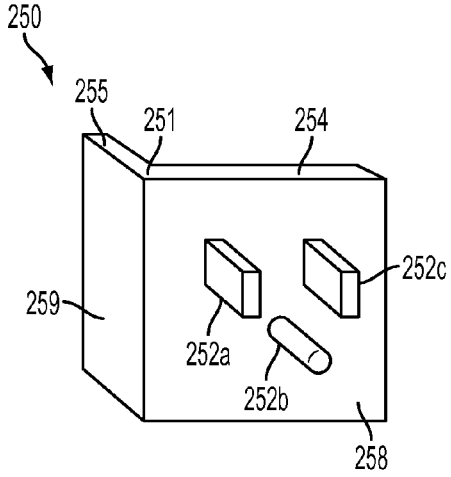
FIGS. 6A to 6C are respectively perspective, side, and perspective views of an alternative electrical plug.
Figure 6B:
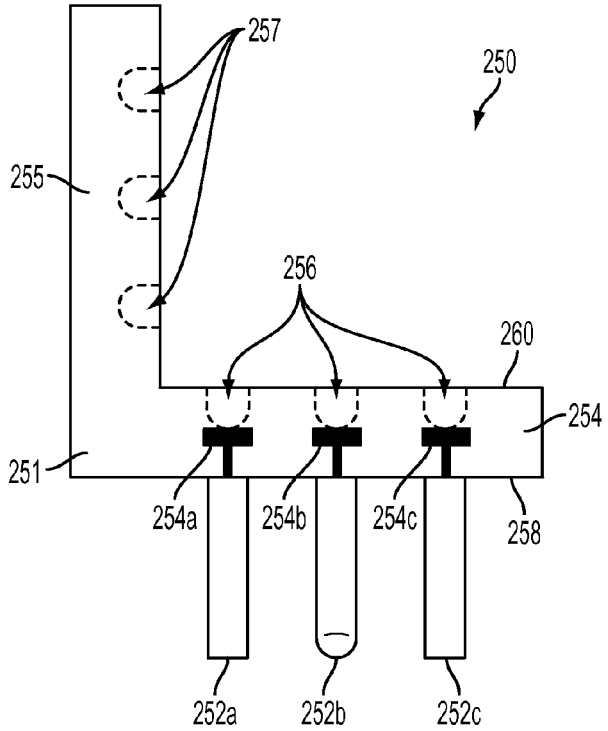
Figure 6C:
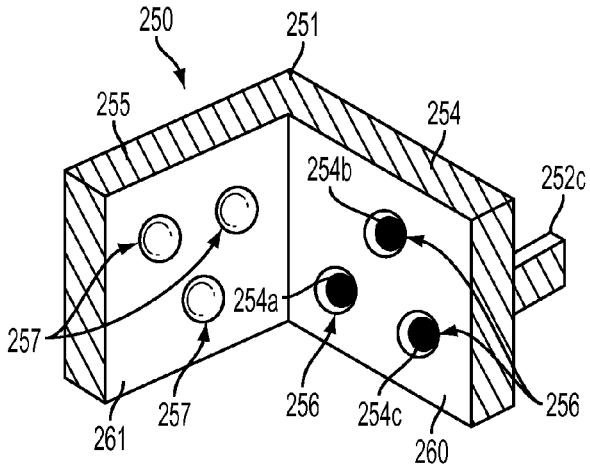
Figure 6D:
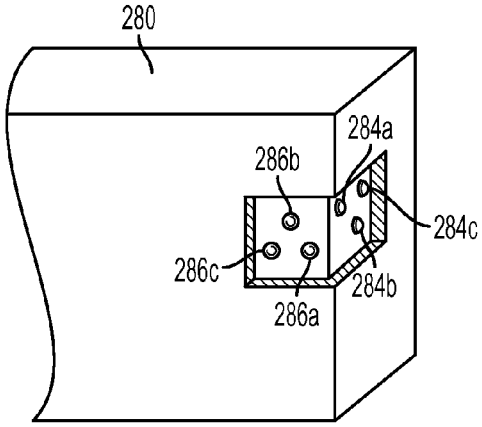
FIG. 6D is a perspective view of a power adapter that receives the electrical plug of FIG. 6A.

FIGS. 6A to 6C are respectively perspective, side, and perspective views of an alternative electrical plug 250. FIG. 6D is a perspective view of an alternative power adapter 280 that receives the electrical plug 250. The plug 250 includes three electrical prongs 252*a*-252*c*, permitting the electrical plug 250 to connect to two AC terminals and an electrically grounded terminal. Like the power adapter 10 and the plug 30 of FIGS. 1A and 1B, the plug 250 and the power adapter 10 can be coupled in at least two orientations.

The plug 250 includes a body 251 that includes a first portion 254 that is substantially in the form of a rectangular plate. The first portion 254 extends in a plane from an edge of a second portion 255, which is also substantially in the form of a rectangular plate. The second portion 255 extends in a plane substantially perpendicular to the plane of the first portion 254. The first portion 254 includes an outer side 258 opposite an inner side 260. The second portion 255 includes an outer side 259 opposite an inner side 261.

Each electrical prong 252*a*-252*c* is electrically connected to a corresponding electrical contact 254*a*-254*c*. The electrical contacts 254*a*-254*c* are located in recesses 256, and recesses 257 are defined in the inner side 261. The recesses 256 and the recesses 257 are rotationally symmetrical such that the configuration of the recesses 256 and the recesses 257 is the same in their respective inner sides 260, 261 except for a 180-degree rotation.

The power adapter 280 includes first electrical contacts 284*a*-284*c* and second electrical contacts 286*a*-286*c* that are received in the recesses 256, 257. In a first orientation, the first electrical contacts 284*a*-284*c* are received in the recesses 256, and each contact 284*a*-284*c* connects electrically with one of the electrical contacts 254*a*-254*c* of the plug 250. In a second orientation, the second electrical contacts 286*a*-286*c* are received in the recesses 256, and each contact 286*a*-286*c* connects electrically with one of the electrical contacts 254*a*-254*c* of the plug 250.

Figure 7A:
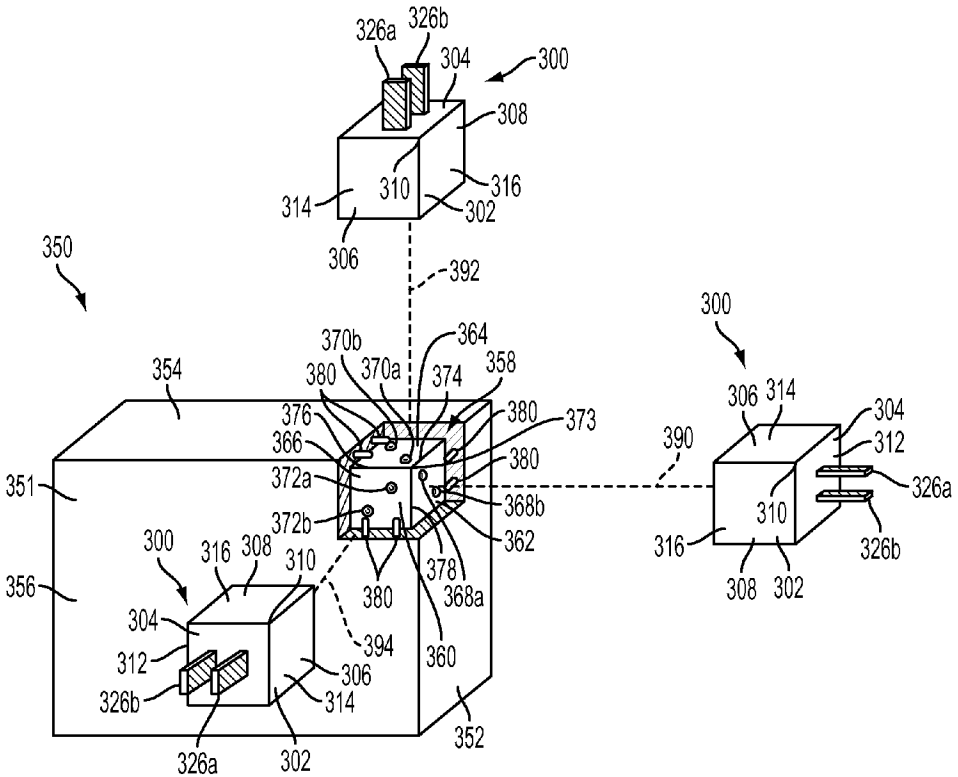
FIG. 7A is a perspective view of an alternative power adapter and an alternative electrical plug.
Figure 7B:
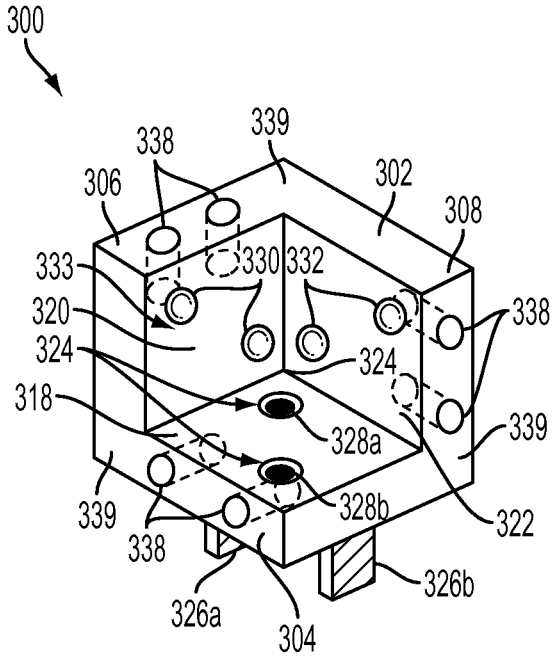
FIG. 7B is a perspective view of the electrical plug of FIG. 7A.

FIG. 7A is a perspective view of an alternative plug 300 and power adapter 350. FIG. 7B is a perspective view of the inside of the plug 300. The power adapter 350 receives the plug 300 in at least three orientations.

The plug 300 includes a body 302 with a first portion 304, a second portion 306, and a third portion 308. The first portion 304, the second portion 306, and the third portion 308 are each shaped as substantially flat plates. The three portions 304, 306, 308 are oriented substantially perpendicular to each other and meet at an exterior corner 310. The three portions 304, 306, 308 have respective outer surfaces 312, 314, 316 that form three adjacent faces of a cube. The three portions 304, 306, 308 also have respective inner sides 318, 320, 322 that meet at an interior corner 324 defined in the body 302.

The plug 300 includes electrical prongs 326*a*, 326*b* coupled to the outer surface 312 of the first portion 304. In the inner side 318 (opposite the surface 312 from which the electrical prongs 326*a*, 326*b* extend), the first portion 304 defines recesses 324. The plug 300 includes an electrical contact 328*a*, 328*b* disposed in each of the recesses 324. Each electrical contact 328*a*, 328*b* is electrically connected to one of the electrical prongs 326*a*, 326*b*. The recesses 324 and the electrical contacts 328*a*, 328*b* can be offset from the electrical prongs 326*a*, 326*b* and can be connected through the body 302 with wires or other conductors.

The second portion 306 defines recesses 330 through the inner side 320, and the third portion 308 defines recesses 332 through the inner side 322. The recesses 330, 332 do not have electrical contacts located within, but are configured to receive electrical contacts 368*a*, 368*b*, 370*a*, 370*b*, 372*a*, 372*b* of the power adapter 350.

The power adapter 350 includes a housing 351 that has a substantially block-like shape and includes three substantially perpendicular exterior sides 352, 354, 356. At a corner where the exterior sides 352, 354, 356 meet, the power adapter 350 includes a receiving portion 358 in which to receive the body 302 of the plug 300. The receiving portion 358 includes a cube-shaped portion 360, which can be selected to have substantially the same size as a cube-shaped recess 333 defined by the inner sides 318, 320, 322 of the body 302. As a result, the body 302 receives the cube shaped portion 360 in the receiving portion 333 of the body 302 when the receiving portion 358 receives the body 302 in the receiving portion 358 of the housing 351.

The cube-shaped portion 360 includes a first side 362, a second side 364, and a third side 366. Each of the sides 362, 364, 366 is substantially flat and is perpendicular to the other two sides 362, 364, 366. First electrical contacts 368*a*, 368*b* are located at the first side 362, second electrical contacts 370*a*, 370*b* are located at the second side 364, and third electrical contacts 372*a*, 372*b* are located at the third side 366. The electrical contacts 368*a*, 368*b*, 370*a*, 370*b*, 372*a*, 372*b* each protrude from their respective sides 362, 364, 366.

The electrical contacts 368*a*, 368*b*, 370*a*, 370*b*, 372*a*, 372*b* are arranged symmetrically about a corner 373 of the cube-shaped portion 360. For example, the electrical contacts 368*a*, 368*b*, 370*a*, 370*b*, 372*a*, 372*b* are arranged with reflectional symmetry across: (i) a first edge 374, formed between the first side 362 and the second side 364; (ii) a second edge 376, formed between the second side 364 and the third side 366; and (iii) a third edge 378 formed between the third side 366 and the first side 362. The positions of any set of the electrical contacts 368*a*, 368*b*, 370*a*, 370*b*, 372*a*, 372*b* is a mirror image or reflection of the other electrical contacts 368*a*, 368*b*, 370*a*, 370*b*, 372*a*, 372*b* across any of the edges 374, 376, 378.

The recesses 324, 330, 332 are arranged with corresponding symmetry to match the positions of the electrical contacts 368*a*, 368*b*, 370*a*, 370*b*, 372*a*, 372*b*. As a result, when the plug 300 is coupled to the power adapter 350, each electrical contact 368*a*, 368*b*, 370*a*, 370*b*, 372*a*, 372*b* is received in one of the recesses 324, 330, 332.

The electrical contacts 368*a*, 368*b*, 370*a*, 370*b*, 372*a*, 372*b* are each connected to adapter circuitry within the housing 351. For example, the adapter circuitry receives electrical input from the first electrical contacts 368*a*, 368*b*, the second electrical contacts 370*a*, 370*b*, or the third electrical contacts 372*a*, 372*b*. In some implementations, the adapter circuitry receives electrical input simultaneously from a combination of the contacts 368*a*, 368*b*, 370*a*, 370*b*, 372*a*, 372*b*.

In some implementations, each of the contacts 368*a*, 370*a*, 372*a* are electrically connected together so that a voltage applied to the contact 368*a* is transmitted to the adapter circuitry and the contacts 370*a*, 372*a*, a voltage applied to the contact 370*a* is transmitted to the adapter circuitry and the contacts 368*a*, 372*a*, and a voltage applied to the contact 372*a* is transmitted to the adapter circuitry and the contacts 370*a*, 372*a*. Each of the contacts 368*b*, 370*b*, 372*b* is electrically connected together in a similar manner.

The body 302 of the plug 300 is received in the receiving portion 358 in at least three orientations. In the first orientation, the body 302 is aligned with the housing 351 along, for example, a first axis 390. At the receiving portion 358, the inner side 318 of the body 302 engages the first side 362 of the housing 351. The first electrical contacts 368*a*, 368*b* are received in the recesses 324, and engage the electrical contacts 328*a*, 328*b* of the plug 300, establishing an electrically conductive connection. The electrical prongs 326*a*, 326*b* extend outward from the housing 351, perpendicular to the exterior side 352.

Also, in the first orientation, the electrical contacts 370*a*, 370*b* are covered by the second portion 306 and are received in the recesses 330, so that the inner side 320 of the body 302 engages the second side 364 of the housing 351. The electrical contacts 372*a*, 372*b* are covered by the third portion 308 and are received in the recesses 332, so that the inner side 322 engages the third side 366.

In the second orientation, the body 302 is aligned with the housing 351 along, for example, a second axis 392. At the receiving portion 358, the inner side 318 of the body 302 engages the second side 364 of the housing 351. The second electrical contacts 370*a*, 370*b* are received in the recesses 324 and engage the electrical contacts 328*a*, 328*b* of the plug 300, establishing an electrically conductive connection. The electrical prongs 326*a*, 326*b* extend outward from the housing 351, perpendicular to the exterior side 354.

Also, in the second orientation, the first electrical contacts 368*a*, 368*b* are covered by the third portion 308 and are received in the recesses 332, so that the inner side 322 of the body 302 engages the first side 362 of the housing 351. The third electrical contacts 372*a*, 372*b* are covered by the second portion 306 and are received in the recesses 330, so that the inner side 320 engages the third side 366.

In the third orientation, the body 302 is aligned with the housing 351 along, for example, a third axis 394. At the receiving portion 358, the inner side 318 of the body 302 engages the third side 366 of the housing 351. The third electrical contacts 372*a*, 372*b* are received in the recesses 324 and engage the electrical contacts 328*a*, 328*b* of the plug 300, establishing an electrically conductive connection. The electrical prongs 326*a*, 326*b* extend outward from the housing 351, perpendicular to the exterior side 356.

Also, in the third orientation, the first electrical contacts 368*a*, 368*b* are covered by the second portion 306 and are received in the recesses 330, such that the inner side 320 of the body 302 engages the first side 362 of the housing 351. The second electrical contacts 370*a*, 370*b* are covered by the second portion 306 and are received in the recesses 332, such that the inner side 322 engages the second side 364.

In each of the three orientations in which the plug 300 is coupled to the power adapter 350, the electrical prongs 326*a*, 326*b* extend perpendicular to different exterior sides 352, 354, 365 of the housing 351. Accordingly, the user can select a particular orientation is advantageous for a particular situation, for example, connecting the power adapter to a wall socket or a power strip. Each electrical contact 368*a*, 370*a*, 372*a* can be connected together, and each electrical contact 368*b*, 370*b*, 372*b* can be connected together, so that the polarity of the electrical connection with the electrical prongs is maintained during each of the three orientations.

The plug 300 can be coupled to the power adapter 350 by, for example, moveable extensions 380 can protrude from or be received in the housing 351. The extensions 380 can be located in the receiving portion 358. For example, the extensions 380 can extend from surfaces 382 in the receiving portion 358.

The body 302 of the plug 300 defines recesses 338 that receive the extensions 380. For example, the body 302 defines the recesses 338 in L-shaped surfaces 339 that are substantially perpendicular to the inner surfaces 318, 320, and 322. The extensions 380 recede into the housing 351 to allow the body 302 to be positioned in the receiving portion 358. When the body 302 is located in the receiving portion 358, the extensions 380 extend from the housing 351 into the recesses 338, securing the plug 300 to the power adapter 350.

Figure 7C:
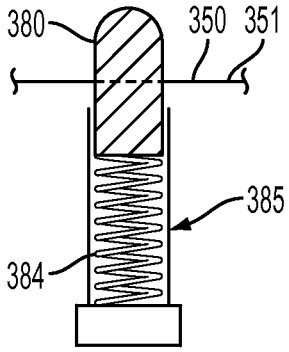
FIG. 7C is a side cutaway view of a portion of the power adapter of FIG. 7A illustrating a moveable extension of the power adapter.

FIG. 7C is a side cutaway view of a portion of the power adapter 350 illustrating a moveable extension 380 of the power adapter 350. The extension 380 can be coupled to a spring 384 located in a compartment 385. As the body 302 is received in the receiving portion 358, the body 302 presses the extension 380 into the compartment 385 and compresses the spring 384. When the body 302 is positioned so that one of the recesses 338 is positioned over the extension 380, the spring 384 presses the extension 380 into the recess 338 to secure the body 302 to the housing 351.

The extensions 380 can be retracted into the compartment 385 to allow the body 302 of the plug 300 to be removed from the power adapter 350. For example, the power adapter 350 can include a switch or other control that causes the extensions to retract.

Additional variations are possible. For example, the power adapter 350 can receive one of several different plugs, and each plug can have a different orientation of electrical prongs. For example, two different plugs can include electrical prongs that extend in the same direction from outer surfaces of the plugs, but the orientation of the electrical prongs of can vary so that the electrical prongs of one plug are oriented at a rotational offset, such as 90 degrees, compared to the other plug. As another example, different plugs can include different shapes and sizes of electrical prongs in order to function with electrical sockets in different countries. In some implementations, a single power adapter 350 can be used with multiple different types of electrical sockets by using a different electrical plug.

The electrical prongs of a plug can also be located at a rotatable face coupled to the body of the plug. The rotatable face can rotate in a plane parallel to an outer side of the plug, allowing the orientation of the electrical prongs of the plug to change relative to an outer side of the plug. For example, the rotatable face can rotate up to 90 degrees, 180 degrees, 270 degrees, 360 degrees or more.

Plugs can include one, two, three or more electrical prongs, and plugs can include one, two, three or more electrical contacts. The electrical contacts of the power adapter can be arranged to connect to one or more electrical contacts of any of several different plugs. Some plugs may not establish an electrical connection with all of the electrical contacts located at a particular surface of a power adapter. Likewise, some power adapters may not establish an electrical connection with all of the electrical contacts located at a particular surface of a plug.

In some implementations, there are no recesses defined in inner surfaces of the plugs. For example, electrical contacts of a plug can be disposed on one or more inner sides and can be flush with the inner sides or can protrude from the inner sides. Accordingly, a power adapter can establish an electrical connection with electrical contacts of the plug with electrical contacts that are positioned flush with surfaces of the power adapter or recessed into the power adapter.

Figure 8A:
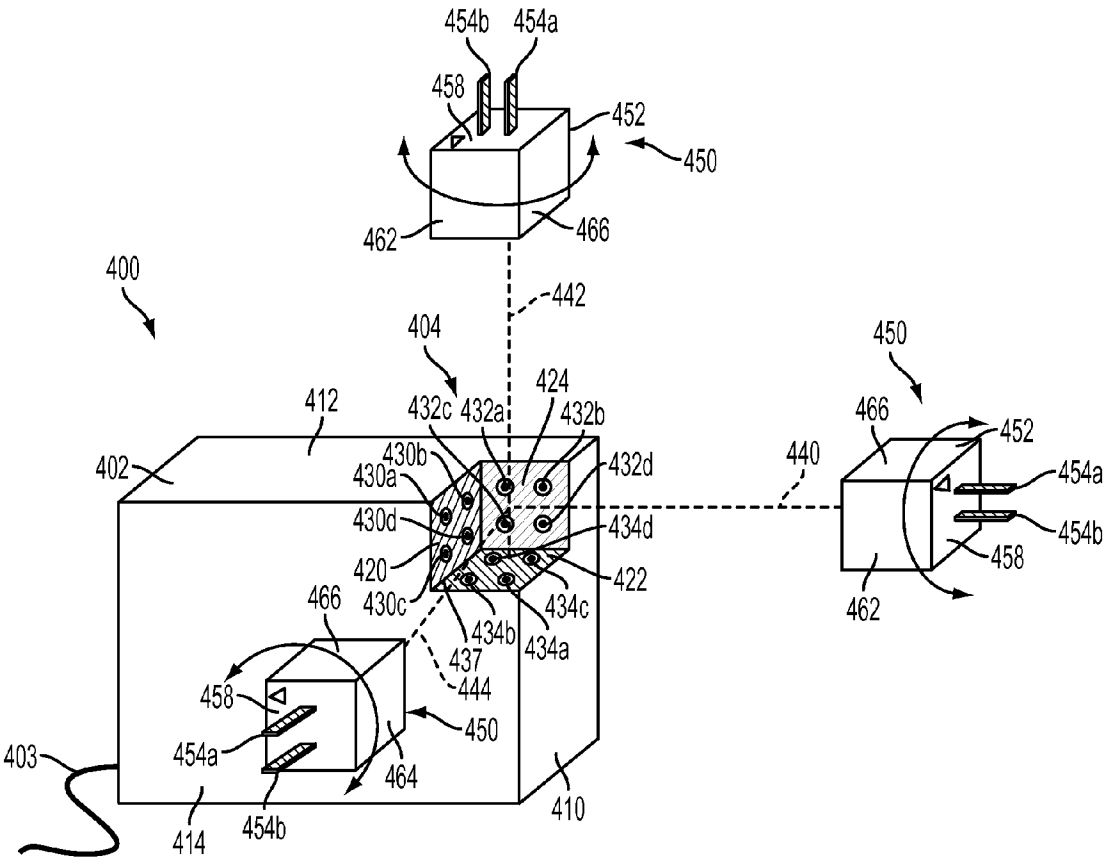
FIG. 8A is a perspective view of an alternative power adapter and an alternative electrical plug.
Figure 8B:
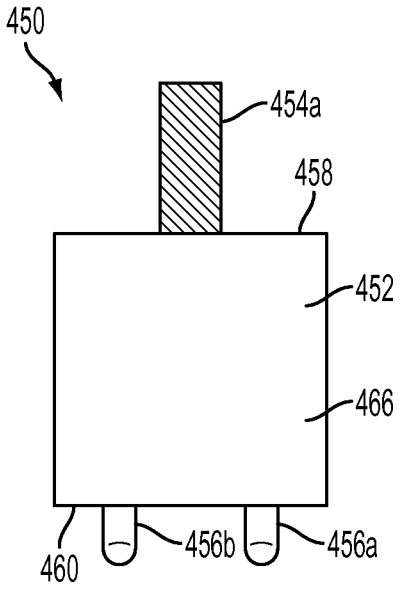
FIG. 8B is a side view of the electrical plug of FIG. 8A.
Figure 8C:
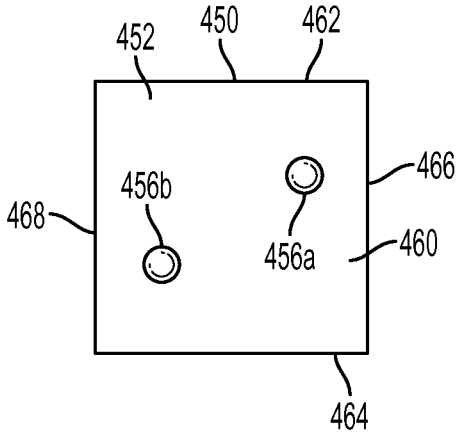
FIG. 8C is an end view of the electrical plug of FIG. 8A.

FIG. 8A is a perspective view of an alternative power adapter 400 and an alternative electrical plug 450. FIG. 8B is a side view of the electrical plug 450. FIG. 8C is an end view of the electrical plug 450.

The electrical plug 450 can be coupled to the power adapter 400 in at least twelve orientations. The electrical plug 450 can be coupled to the power adapter 400 in alignment with a first axis 440, a second axis 442, or a third axis 444. For each axis 440, 442, 444, the electrical plug 450 can be coupled to the power adapter 400 at any of four rotational orientations (a rotational offset of 0 degrees, 90 degrees, 180 degrees, or 270 degrees), for a total of at least twelve orientations of the plug relative to the housing. In each of the twelve orientations, electrical contacts 456*a*, 456*b* of the plug 450 engage one or more of the electrical contacts 430*a*-430*d*, 432*a*-432*d*, 434*a*-434*d* of the power adapter 400, causing an electrically conductive connection to be established between the plug 450 and the power adapter 400.

The electrical plug 450 includes a body 452, one or more electrical prongs 454*a*, 454*b*, and one or more electrical contacts 456*a*, 456*b*. The body 452 can be substantially shaped as a rectangular prism (e.g., cuboid). The body 452 can be substantially cube-shaped. Nevertheless, in some implementations, the body 452 can have rounded edges, rounded corners, irregular surface contours, grooves, recesses, and other features.

In the illustrated example, the body 452 includes a first side 458 and a second side 460 opposite the first side 458. The first side 458 and the second side 460 can be substantially parallel to each other. The body 452 also includes a third side 462 opposite a fourth side 464, and a fifth side 466 opposite a sixth side 468. The third side 462 and the fourth side 464 are substantially parallel to each other, and the fifth side 466 and the sixth side 468 are substantially parallel to each other. The third side 462 and the fourth side 464 are oriented substantially orthogonal to (i) the first side 458 and the second side 460, and (ii) the fifth side 466 and the sixth side 468. Similarly, the fifth side 466 and the sixth side 468 are oriented substantially orthogonal to (i) the first side 458 and the second side 460, and (ii) the third side 462 and the fourth side 464. Thus the body 452 can include three pairs of substantially parallel sides (e.g., 458 and 460; 462 and 464; and 466 and 468), and each pair of substantially parallel sides can be substantially orthogonal to the other two pairs of substantially perpendicular sides.

The sides 458, 460, 462, 464, 466, 468 can form the outer surface of the body 452. For example, at least a portion of each of the sides 458, 460, 462, 464, 466, 468 can define a portion of the outer surface of the body 452.

The electrical prongs 454*a*, 454*b* extend from the first side 458. For example, the electrical prongs 454*a*, 454*b* extend orthogonal to the first side 458. The body 452 can include, for example, two or more electrical prongs 454*a*, 454*b*.

The electrical contacts 456*a*, 456*b* are located at the second side 460. The electrical contacts 456*a*, 456*b* can protrude from the second side 460. For example, the electrical contacts 456*a*, 456*b* can extend substantially orthogonal to the second surface 460. In some implementations, however, the electrical contacts 456*a*, 456*b* are flush with the second side 460 or are recessed into the second side 460.

The plug 450 can include one, two, three, or more than three electrical contacts 456*a*, 456*b*. For example, for each electrical prong 454*a*, 454*b*, the plug 450 can include a corresponding electrical contact 456*a*, 456*b*. The electrical contacts 456*a*, 456*b* can be coupled to the electrical prongs 454*a*, 454*b*. For example, the plug 450 can include circuitry that establishes an electrically conductive connection between the electrical contacts 456*a*, 456*b* and the electrical prongs 454*a*, 454*b*. In some implementations, the circuitry can include a safety mechanism coupled between one or more electrical contacts 456*a*, 456*b* and one or more electrical prongs 454*a*, 454*b*. Examples of safety mechanisms include, for example, fuses, switches, circuit breakers, ground fault interruption circuits, surge suppression elements, and current limiting elements.

Each electrical contact 456*a*, 456*b* can be connected to a different electrical prong 454*a*, 454*b*. In some implementations, one or more electrical contacts 456*a*, 456*b* can be connected to multiple electrical prongs 454*a*, 454*b*, and/or one or more electrical prongs 454*a*, 454*b* can be connected to multiple electrical contacts 456*a*, 456*b*.

The power adapter 400 includes a housing 402 that includes a first exterior side 410, a second exterior side 412, and a third exterior side 414. Each exterior side 410, 412, 414 can be substantially orthogonal to the other exterior sides 410, 412, 414. The housing 402 includes a receiving portion 404 that can receive at least a portion of the body 452 of the plug 450. The receiving portion 404 can approximate the shape and size of the body 452. For example, the body 452 can be substantially cube-shaped, and the receiving portion 404 can be substantially cube-shaped. The receiving portion 404 can be defined in a corner of the housing 402.

The body 452 of the plug 450 can be received in the receiving portion 404 so that the electrical prongs 454*a*, 454*b* extend substantially parallel to one of the axes 440, 442, 444. The three axes 440, 442, 444 can be mutually orthogonal. Orientations of the plug 450 along different axes 440, 442, 444 can result in the electrical prongs 454*a*, 454*b* extending orthogonal to different exterior sides 410, 412, 414. That is, when the plug 450 is coupled to the housing 402 along the first axis 440, the electrical prongs 454*a*, 454*b* extend substantially in the direction of the first axis 440, substantially orthogonal to the first exterior side 410. When the plug 450 is coupled to the housing 402 along the second axis 442, the electrical prongs 454*a*, 454*b* extend substantially in the direction of the second axis 442, substantially orthogonal to the second exterior side 412. When the plug 450 is coupled to the housing 402 along the third axis 444, the electrical prongs 454*a*, 454*b* extend substantially in the direction of the third axis 444, substantially orthogonal to the third side exterior side 414.

Figure 10A:
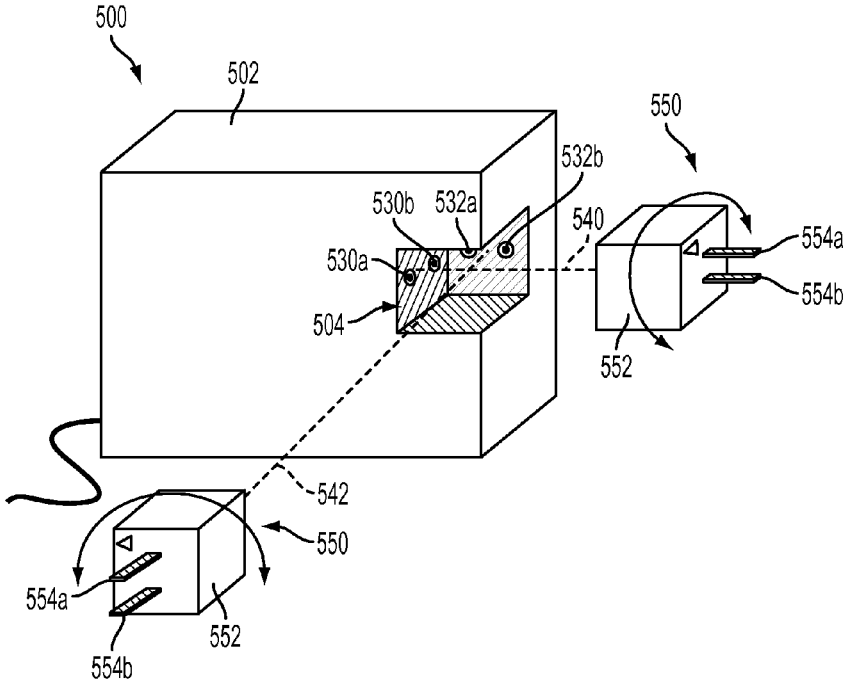
FIG. 10A is a perspective view of an alternative power adapter and an alternative electrical plug.

As an alternative, the receiving portion 404 can be defined in an edge of the housing 402, but not at a corner (see FIG. 10A). Such a receiving portion 404 would allow the plug 450 to be coupled to the housing 402 along two axes instead of three. As another alternative, the receiving portion 404 can be defined in one of the exterior sides 410, 412, 414 of the housing 402, and may not be defined at an edge or a corner. Such a receiving portion 404 would allow the plug 450 to be coupled to the housing 402 along one axis. Still, even with the plug 450 oriented so that the electrical prongs 454*a*, 454*b* are aligned along a single axis, the body 452 can be received in the receiving portion 404 in four orientations due to rotational offsets of the plug 450.

Located in the receiving portion 404, the housing 402 includes a first surface 420, a second surface 422, and a third surface 424. The first surface 420, the second surface 422, and the third surface 424 can be substantially orthogonal to each other. The first surface 420, the second surface 422, and the third surface 424 can extend inwardly from the exterior of the housing 402, for example, from the exterior sides 410, 412, 414. The first surface 420 can be substantially parallel to the first exterior side 410, the second surface 422 can be substantially parallel to the second exterior side 412, and the third surface 424 can be substantially parallel to the third exterior side 414. The first surface 420, the second surface 422, and the third surface 424 can define the receiving portion 404.

The power adapter 400 can include contacts that engage electrical contacts 456*a*, 456*b* of the plug 450 in different orientations of the plug 450 relative to the power adapter 400. For example, in a on orientation of the plug 450 relative to the power adapter 400, the electrical contacts 456*a*, 456*b* can engage first electrical contacts. In a different orientation of the plug 450 relative to the power adapter, the electrical contacts 456*a*, 456*b* can engage second electrical contacts. A set or group of contacts (e.g., first electrical contacts, or second electrical contacts) can be located at a single side or multiple sides of the receiving portion 404. Sets of contacts can overlap, such that two sets of contacts have one or more contacts in common. Sets of contacts can also include one or more contacts not shared with any other set, but need not do so. Different sets of contacts can be located at different sides of the receiving portion 404, but need not be so arranged.

In the example of FIG. 8A, the power adapter 400 includes one or more electrical contacts 430*a*-430*d*, 432*a*-432*d* 434*a*-434*d* located at each surface 420, 422, 424. For example, first electrical contacts 430*a*-430*d* are located at the first surface 420, second electrical contacts 432*a*-432*d* are located at the second surface 422, and third electrical contacts 434*a*-434*d* are located at the third surface 424. The electrical contacts 430*a*-430*d*, 432*a*-432*d*, 434*a*-434*d* can each be recessed into their respective surfaces 420, 422, 424 to receive the electrical contacts 456*a*, 456*b* of the plug 450.

In some implementations, at least as many electrical contacts 430*a*-430*d*, 432*a*-432*d*, 434*a*-434*d* as the number of electrical prongs 454*a*-454*d* of the plug 450 can be located at each surface 420, 422, 424. For example, the plug 450 includes two electrical prongs 454*a*-454*d*, so at least two electrical contacts 430*a*-430*d*, 432*a*-432*d*, 434*a*-434*d* can be included at each surface 420, 422, 424. In some implementations, more or fewer electrical contacts 430*a*-430*d*, 432*a*-432*d*, 434*a*-434*d* at each surface 420, 422, 424. As a result, for one or more orientations of the plug 450 relative to the power adapter 400, some electrical contacts 430*a*-430*d*, 432*a*-432*d*, 434*a*-434*d* at a particular surface 420, 422, 424 can be connected to electrical contacts 456*a*, 456*b* of the plug 450 while others at that surface 420, 422, 424 are not.

Two or more of the electrical contacts 430*a*-430*d*, 432*a*-432*d*, 434*a*-434*d* can be electrically connected to each other. For example, different groupings of the electrical contacts 430*a*-430*d*, 432*a*-432*d*, 434*a*-434*d* can be connected to different inputs of adapter circuitry in the housing 402. An output of the adapter circuitry can be transmitted through a cable 403 coupled to the housing 402. Because multiple electrical contacts 430*a*-430*d*, 432*a*-432*d*, 434*a*-434*d* can be tied to a single input of the adapter circuitry, the adapter circuitry can be simplified. For example, the adapter circuitry can have fewer inputs than the total number of electrical contacts 430*a*-430*d*, 432*a*-432*d*, 434*a*-434*d* or the number of surfaces 420, 422, 424 in the receiving portion 404. Connections between the various subsets of the twelve electrical contacts 430*a*-430*d*, 432*a*-432*d*, 434*a*-434*d* can enable the adapter circuitry to function with two inputs, for example, one input corresponding to each prong 454*a*, 454*b* of the plug 450.

As an example, consider the engagement of the electrical contacts 456*a*, 456*b* of the plug 450 with the electrical contacts 430*a*-430*d* at the first surface 420. The electrical contacts 456*a*, 456*b* of the plug 450 are disposed diagonally at the side 460. As a result, only electrical contacts 430*a*-430*d* positioned diagonally from each other can be simultaneously engage the electrical contacts 456*a*, 456*b* of the plug 450

(e.g., electrical contacts 430*a*, 430*d*, or electrical contacts 430*b*, 430*c*). Electrical contacts 430*a*-430*d* that are not arranged diagonally to each other (e.g., the electrical contacts 430*a*, 430*c*; and the electrical contacts 430*a*, 430*b*), will never be simultaneously connected to the electrical contacts 456*a*, 456*b* of the plug 450, in any orientation that the plug 450 can be coupled to the power adapter 400 along the first axis 440. As a result, of the first electrical contacts 430*a*-430*d*, a first subset including the electrical contacts 430*a*, 430*c* can be connected together, and a second subset including of the electrical contacts 430*b*, 430*d* can be connected together. With these connections, there is no orientation that will cause a short circuit between the electrical contacts 456*a*, 456*b* of the plug 450.

As another example, some of the electrical contacts 430*a*-430*d*, 432*a*-432*d*, 434*a*-434*d* at different surfaces 420, 422, 424 can also be connected together. For example, the electrical contacts 430*a*, 430*b*, 432*a*, 432*b*, 434*a*, 434*b* can be connected together and can be connected to one input of the adapter circuitry. The electrical contacts 430*c*, 430*d*, 432*c*, 432*d*, 434*c*, 434*d* can also be connected together and can be connected to another input of the adapter circuitry. In all the different orientations that the plug 450 can be coupled to the power adapter 400, power is transmitted from the plug 450 to the two inputs of the adapter circuitry, and no short circuit will occur between the electrical contacts 456*a*, 456*b* of the plug 450.

The electrical contacts 430*a*-430*d*, 432*a*-432*d*, 434*a*-434*d* located at a particular surface 420,422, 424 can, but are not required to, be arranged with one or more types of symmetry. In particular, two or more contacts can be arranged with rotational symmetry in one of the surfaces 420, 422, 424. For example, the electrical contacts 430*a*-430*d* located at the first surface 420 are arranged with rotational symmetry at the first surface 420. In one orientation of the plug 450 to the housing 402 along the first axis 440, the electrical contact 456*a* engages the electrical contact 430*a*. The plug 450 can be removed, rotated 90 degrees about the first axis 440, and replaced along the first axis 440 such that the electrical contact 456*a* engages the electrical contact 430*b*. Similarly, the plug 450 can be repositioned further so that the electrical contact 456*a* engages the electrical contact 430*c* or the electrical contact 430*d*.

The first electrical contacts 430*a*-430*d*, the second electrical contacts 432*a*-432*d*, and the third electrical contacts 434*a*-434*d* can be, but are not required to be, symmetrically arranged at their respective surfaces 420, 422, 424. For example, the first electrical contacts 430*a*-430*d* can be arranged with one or more types of symmetry with respect to the second electrical contacts 432*a*-432*d* and/or the third electrical contacts 434*a*-434*d*. The electrical contacts 430*a*-430*d*, 432*a*-432*d*, 434*a*-434*d* at different surfaces 420, 422, 424 can be arranged with reflectional symmetry. As an example, the location of one or more electrical contacts 430*a*-430*d* in the first surface 420 mirrors the location of one or more electrical contacts 432*a*-432*d* in the second surface 422 across an edge 437 between the surfaces 420, 422. In addition, or alternatively, electrical contacts 430*a*-430*d*, 432*a*-432*d*, 434*a*-434*d* at different surfaces 420, 422, 424 can also be arranged with rotational symmetry with respect to each other. In addition, or alternatively, other relationships and other types of symmetry can be exist between the electrical contacts 430*a*-430*d*, 432*a*-432*d*, 434*a*-434*d*.

The body 452 of the plug 450 is received in the receiving portion 404 in at least twelve orientations. In each of the orientations, each electrical contact 456*a*, 456*b* of the plug 450 engages one of the electrical contacts 430*a*-430*d*, 432*a*-432*d*, 434*a*-434*d* of the power adapter 400. The engagement of the electrical contact 456*a*, 456*b* and the electrical contacts 430*a*-430*d*, 432*a*-432*d*, 434*a*-434*d* creates an electrically conductive connection, so that electricity can flow from the electrical prongs 454*a*, 454*b* to the adapter circuitry in the housing 402.

Figure 9B:
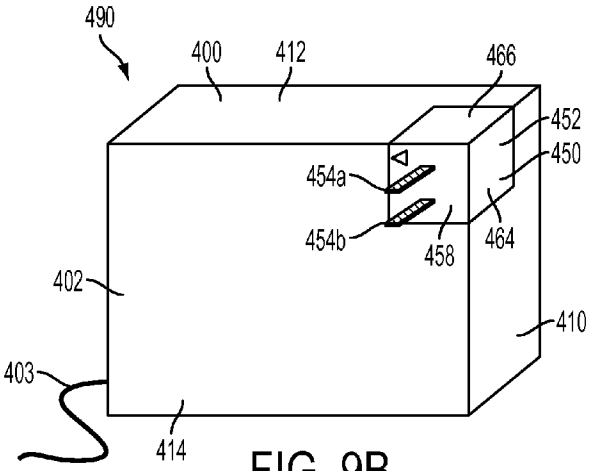
FIGS. 9A to 9C are perspective views of power adapter assemblies illustrating different orientations in which the electrical plug of FIG. 8A can be coupled to the power adapter of FIG. 8A.
Figure 9A:
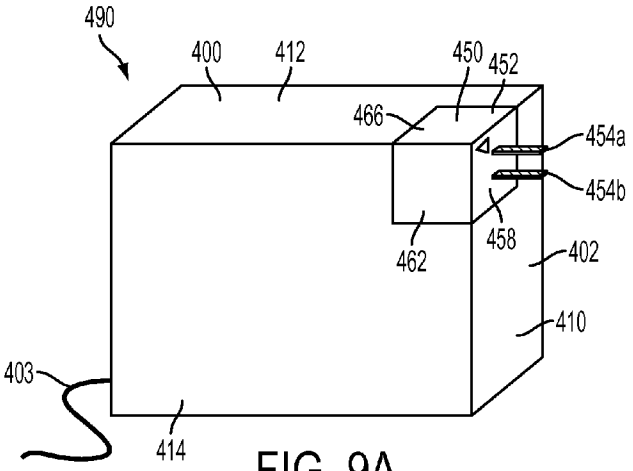
Figure 9C:
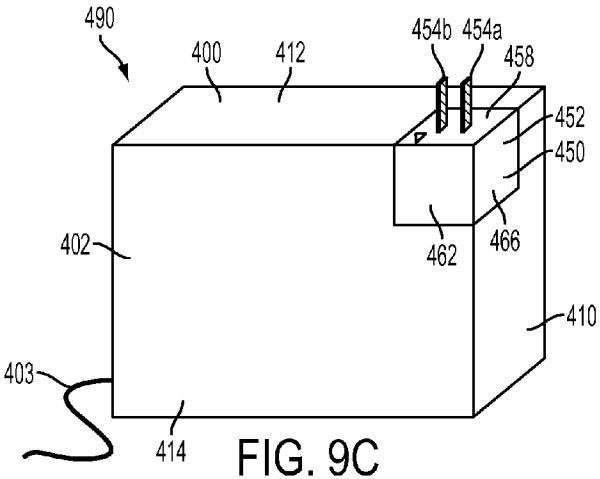

The plug 450 can be coupled to the power adapter 400 to form a power adapter assembly 490 (FIGS. 9A to 9C). The plug 450 can be coupled to the power adapter 400 along the first axis 440, such that the electrical contacts 456*a*, 456*b* each engage one of the electrical contacts 430*a*-430*d*. The electrical prongs 454*a*, 454*b* can extend substantially perpendicular to the first exterior side 410, as shown in FIG. 9A. The plug 450 can also coupled to the power adapter 400 along the second axis 442, such that the electrical contacts 456*a*, 456*b* each engage one of the electrical contacts 432*a*-432*d*. The electrical prongs 454*a*, 454*b* can extend substantially perpendicular to the second exterior side 412, shown in FIG. 9B. The plug 450 can also be coupled to the power adapter 400 along the third axis 444, such that the electrical contacts 456*a*, 456*b* each engage one of the electrical contacts 434*a*-434*d*. The electrical prongs 454*a*, 454*b* can extend substantially perpendicular to the third exterior side 414, shown in FIG. 9C. Along each axis 440, 442, 444, the plug 450 can be coupled in four different rotational positions relative to the power adapter 400.

Table 1, below, indicates the connections of the electrical contacts 456*a*, 456*b* to the electrical contacts 430*a*-430*d*, 432*a*-432*d*, 434*a*-434*d* in each of the twelve orientations.

TABLE 1

Electrical Connections in Various Orientations of the Plug 450 Relative to the Power Adapter 400

| Column 1 Orientation | Column 2 The electrical prongs 454a, 454b are aligned substantially parallel to: | Column 3 The electrical contact 456a engages: | Column 4 The electrical contact 456b engages: | Column 5 Relative rotation of the plug 450 about the axis of Column 2: |
|---|---|---|---|---|
| 1 | First Axis 440 | Electrical contact 430a | Electrical contact 430d | 0 degrees |
| 2 | First Axis 440 | Electrical contact 430b | Electrical contact 430c | 90 degrees |
| 3 | First Axis 440 | Electrical contact 430d | Electrical contact 430a | 180 degrees |
| 4 | First Axis 440 | Electrical contact 430c | Electrical contact 430b | 270 degrees |
| 5 | Second Axis 442 | Electrical contact 432a | Electrical contact 432d | 0 degrees |
| 6 | Second Axis 442 | Electrical contact 432b | Electrical contact 432c | 90 degrees |
| 7 | Second Axis 442 | Electrical contact 432d | Electrical contact 432a | 180 degrees |
| 8 | Second Axis 442 | Electrical contact 432c | Electrical contact 432b | 270 degrees |
| 9 | Third Axis 444 | Electrical contact 434a | Electrical contact 434d | 0 degrees |
| 10 | Third Axis 444 | Electrical contact 434b | Electrical contact 434c | 90 degrees |
| 11 | Third Axis 444 | Electrical contact 434d | Electrical contact 434a | 180 degrees |
| 12 | Third Axis 444 | Electrical contact 434c | Electrical contact 434b | 270 degrees |

In each orientation of the plug 450 to the power adapter 400, only two of the twelve electrical contacts 430*a*-430*d*, 432*a*-432*d*, 434*a*-434*d* are connected to the electrical contacts 456*a*, 456*b*. The body 452 of the plug 450 covers the electrical contacts 430*a*-430*d*, 432*a*-432*d*, 434*a*-434*d* that do not engage one of electrical contacts 456*a*, 456*b* of the plug 450. As a result, when the plug 450 is coupled to the power adapter 400, none of the electrical contacts 430*a*-430*d*, 432*a*-432*d*, 434*a*-434*d* are exposed.

A number of variations can be made. For example, more or fewer electrical contacts 430*a*-430*d*, 432*a*-432*d*, 434*a*-434*d* and electrical contacts 456*a*-456 can be included. The locations and connections between the electrical contacts 430*a*-430*d*, 432*a*-432*d*, 434*a*-434*d*, 456*a*, 456*b* can also be varied. The placement and number of electrical contacts 430*a*-430*d*, 432*a*-432*d*, 434*a*-434*d*, 456*a*, 456*b* can allow or disallow particular orientations of the plug 450 relative to the housing 402.

The electrical contacts 456*a*, 456*b* of the plug 450 can be flush with the side 460 of the body 452 or can be recessed into the side 460 of the body 452. The electrical contacts 430*a*-430*d*, 432*a*-432*d*, 434*a*-434*d* of the power adapter 400 can be flush with the surfaces 420, 422, 424 or can extend from the surfaces 420, 422, 424. The body 452 can define recesses, holes, channels, grooves or other features to admit the electrical contacts 430*a*-430*d*, 432*a*-432*d*, 434*a*-434*d*. For example, to connect with a power adapter 400 in which electrical contacts 430*a*-430*d*, 432*a*-432*d*, 434*a*-434*d* extend from the surfaces 420, 422, 424, the body 452 of the plug 450 can define grooves in one or more sides 458, 460, 462, 464 to admit the electrical contacts 430*a*-430*d*, 432*a*-432*d*, 434*a*-434*d*. Thus electrical contacts 430*a*-430*d*, 432*a*-432*d*, 434*a*-434*d* that protrude into the receiving portion 404 can be received in the body 452 so that the sides 458, 460, 462, 464 of the body 452 can engage the surfaces 420, 422, 424 in the receiving portion 404, without being impeded by the electrical contacts 430*a*-430*d*, 432*a*-432*d*, 434*a*-434*d*.

The power adapter 400 can receive one of several different electrical plugs. For example different plugs can include electrical prongs for different types of outlets. One plug can include two electrical prongs, and another can include three electrical prongs. Various electrical plugs can be configured for use with different international socket types or different voltage levels. Different electrical plugs can connect to different electrical contacts 430*a*-430*d*, 432*a*-432*d*, 434*a*-434*d* of the power adapter 400.

In some implementations, a plug can be moved from one orientation to another orientation relative to a power adapter housing without the plug being removed from the housing. For example, in addition to, or as an alternative to, the orientations achievable by removing and replacing the plug, the plug can include a body component that can move (for example, pivot, swivel, rotate, translate, twist, tilt, or combinations thereof) relative to the housing while the plug is engaged with the housing.

When the body component moves while in engagement with the housing, electrical contacts of the body may remain in contact with a single set of electrical contacts of the housing, or may move to engage one or more different contacts of the housing. The electrical prongs of the plug can extend from the movable body component, and the movable body component can be captured by the housing, can be captured by another plug body element, or can be removable. The movable body component can move such that the angle of the electrical prongs is altered relative to an axis of the housing, for example, permitting the electrical prongs to extend in a direction not orthogonal to any of the side surfaces of the housing. The movable body component can move such that the electrical prongs shift from a first side of the housing to a different side of the housing.

For example, when the plug is located at a corner of a substantially rectangular housing, a moveable body component of the plug can swivel, permitting electrical prongs extending from the moveable body component to be positioned such that they extend from any of three orthogonal sides of the housing.

The plug can include a moveable body component that can pivot about an axis. Pivoting of the moveable body component can cause electrical prongs extending from the moveable body member to move between a first direction along a reference axis perpendicular to the pivot axis to a second, opposite direction along the reference axis. In this manner the position of the prongs can move through a range of motion of, for example, 180 degrees or more.

A plug including a moveable body component can include a locking mechanism to secure the position of the moveable body component relative to the plug body and/or the housing. The locking mechanism may secure the prongs at discrete positions or increments, but need not do so.

Figure 10B:
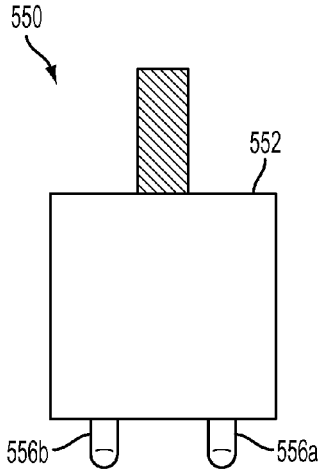
FIG. 10B is a side view of the electrical plug of FIG. 10A.
Figure 10C:
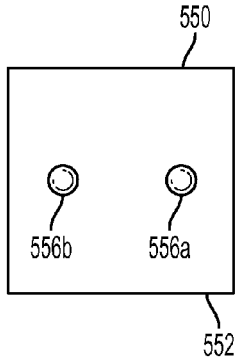
FIG. 10C is an end view of the electrical plug of FIG. 10A.

FIG. 10A is a perspective view of an alternative power adapter 500 and an alternative electrical plug 550. FIG. 10B is a side view of the electrical plug 550. FIG. 10C is an end view of the electrical plug 550.

The plug 550 can be coupled to the power adapter 500 in one of four orientations. The plug 550 can be coupled to the power adapter 500 along a first axis 540 or along a second axis 542. Along each axis 540, 542, the plug 550 can be coupled in two orientations, each offset by 180 degrees.

The plug 550 includes a body 552, two electrical prongs 554*a*, 554*b*, and two electrical contacts 556*a*, 556*b*. The electrical prong 554*a* is connected to the electrical contact 556*a* by circuitry in the body 552, and the electrical prong 554*b* is connected to the electrical contact 556*b* by circuitry in the body 552.

The power adapter 500 includes a housing 502 that includes a receiving portion 504 at an edge 506 of the housing 502. On the receiving portion 504, the power adapter 500 includes first electrical contacts 530*a*, 530*b* and second electrical contacts 532*a*, 532*b*. Due to the positions of the electrical contacts 530*a*, 530*b*, 532*a*, 532*b*, the plug 550 can only be coupled to the power adapter 500 in particular orientations. For example, the plug 550 cannot be coupled to the power adapter 500 along the first axis 540 in two orientations that have a 90 degree rotational offset. The allowed orientations of the plug 550 relative to the power adapter 500 are indicated in Table 2, below. In other implementations, different numbers of electrical contacts 530*a*, 530*b*, 532*a*, 532*b* and different placement of the electrical contacts 530*a*, 530*b*, 532*a*, 532*b* can allow more or fewer orientations of the plug 550 to the power adapter 500.

TABLE 2

Electrical Connections in Various Orientations of the Plug 550 Relative to the Power Adapter 500

| Orientation: | Alignment of the electrical prongs 554a, 554b: | The electrical contact 556a engages: | The electrical contact 556b engages: | Relative rotation of the plug 550 about the axis: |
|---|---|---|---|---|
| 1 | First Axis 540 | Electrical contact 530a | Electrical contact 530b | 0 degrees |
| 2 | First Axis 540 | Electrical contact 530b | Electrical contact 530a | 180 degrees |
| 3 | Second Axis 542 | Electrical contact 532a | Electrical contact 532b | 0 degrees |
| 4 | Second Axis 542 | Electrical contact 532b | Electrical contact 532a | 180 degrees |

Figures 11A, 11B, 11C, 11D:
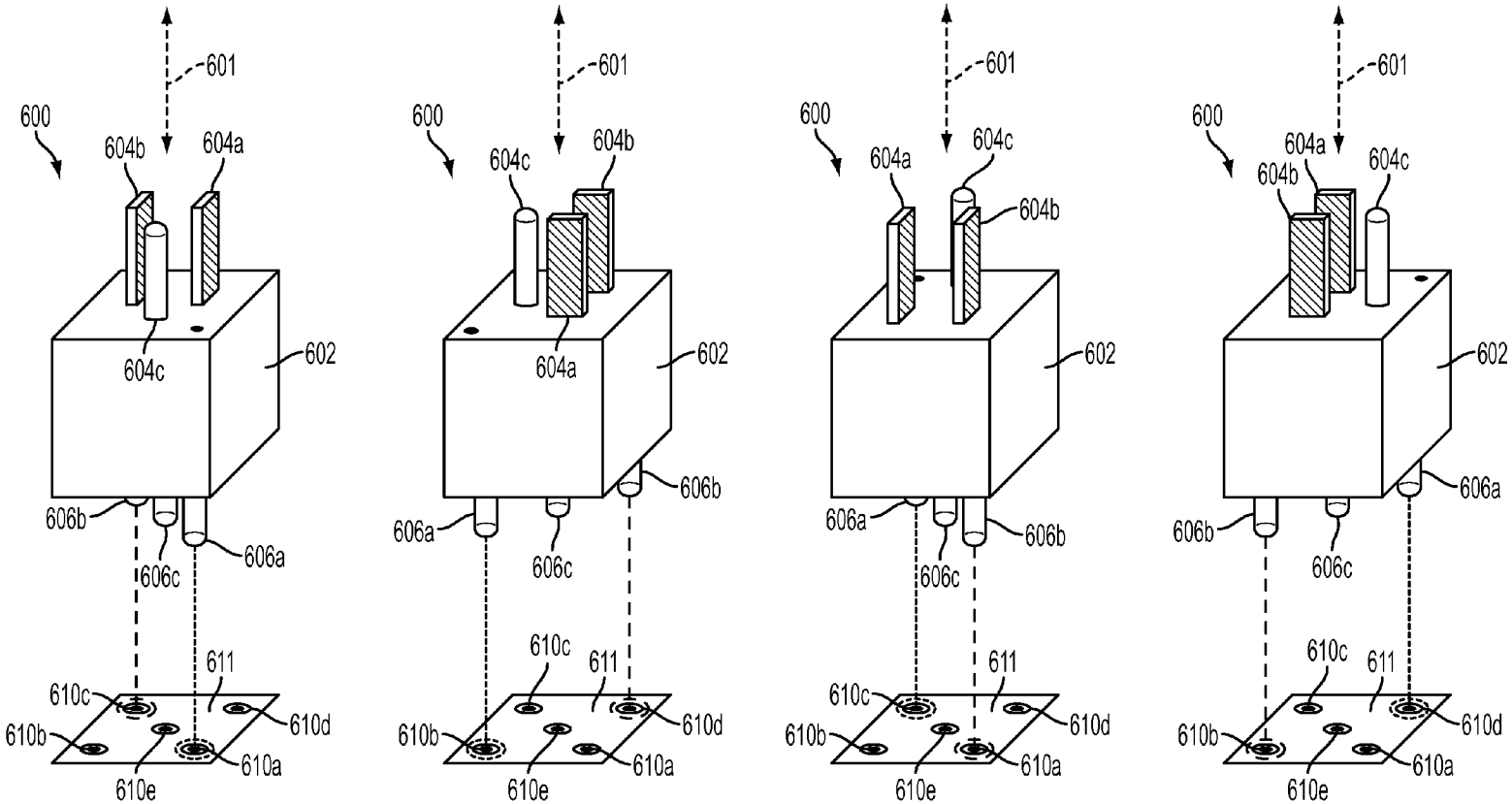
FIGS. 11A to 11D are perspective views illustrating various alignments in which an electrical plug can engage electrical contacts of a power adapter.

FIGS. 11A to 11D are perspective views illustrating various alignments in which an electrical plug 600 can engage electrical contacts 610*a*-610*e* of a power adapter. FIGS. 11A to 11D illustrate different rotational orientations of the plug 600 relative to the electrical contacts 610*a*-610*e* while the plug 600 is aligned in the direction of a single axis 601. For example, FIG. 11A illustrates a first orientation of the plug 600 relative to the electrical contacts 610*a*-610*e*. FIGS. 11B to 11D illustrate the plug 600 rotated clockwise about the axis 601 respectively 90 degrees, 180 degrees, and 270 degrees from the position of FIG. 11A. In each of the four orientations, the plug 600 establishes an electrically conductive connection with at least some of the electrical contacts 610*a*-610*e*. In each of the orientations, a grounded electrical contact 606*c* of the plug 600 engages the corresponding electrical contact 610*e* for electrical ground.

The plug 600 includes a body 602, electrical prongs 604*a*-604*c*, and electrical contacts 606*a*-606*c*. Two of the electrical prongs 604*a*, 604*b* are sized to connect AC power terminals of a power outlet, and the other electrical prong 604*c* is sized to connect to a ground terminal of a power outlet. Each electrical prong 604*a*-604*c* is connected to a respective electrical contact 606*a*-606*c*. The electrical prong 604*a* is connected to the electrical contact 606*a*, the electrical prong 604*b* is connected to the electrical contact 606*b*, and the electrical prong 604*c* is connected to the electrical contact 606*c*.

The electrical contacts 610*a*-610*e* are located at a surface 611, and can be recessed into the surface 611. The surface 611 can be located at a receiving portion of a housing of a power adapter, for example.

In each of the orientations of FIGS. 11A to 11D, the electrical contacts 606*a*-606*b* of the plug 600 engage different electrical contacts 610*a*-610*d* at the surface 611, as indicated in Table 3, below. The electrical contact 606*c* of the plug 600 engages the electrical contact 610*e* in all orientations to establish a consistent ground path from the electrical prong 604*c* to the electrical contact 610*e*.

TABLE 3

Electrical Connections of the Plug 600 Relative to the Electrical Contacts 610a-610e in FIGS. 11A to 11D

| Orientation: | The electrical contact 606a engages: | The electrical contact 606b engages: | The electrical contact 606c engages: | Clockwise rotation of the plug 600 relative to FIG. 11A: |
|---|---|---|---|---|
| FIG. 11A | Electrical contact 610a | Electrical contact 610c | Electrical contact 610e | 0 degrees |
| FIG. 11B | Electrical contact 610b | Electrical contact 610d | Electrical contact 610e | 90 degrees |
| FIG. 11C | Electrical contact 610c | Electrical contact 610a | Electrical contact 610e | 180 degrees |
| FIG. 11D | Electrical contact 610d | Electrical contact 610b | Electrical contact 610e | 270 degrees |

Figure 12A:
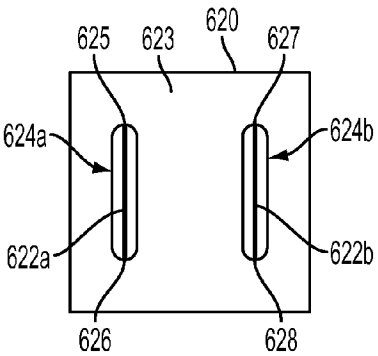
FIGS. 12A to 12C are diagrams illustrating alternative arrangements of electrical contacts for a power adapter.
Figure 12B:
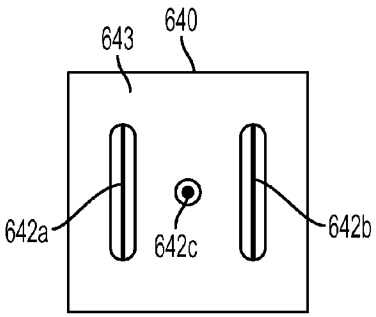
Figure 12C:
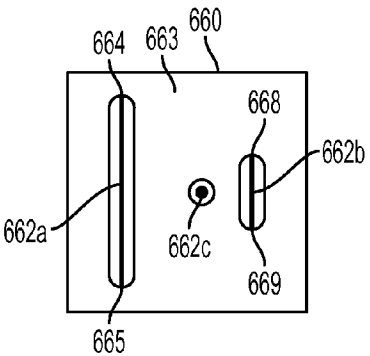
Figure 12D:
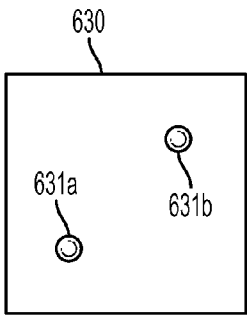
FIGS. 12D to 12F are diagrams of alternative arrangements of electrical contacts of electrical plugs configured to engage the electrical contacts of FIGS. 12A to 12C, respectively.
Figure 12E:
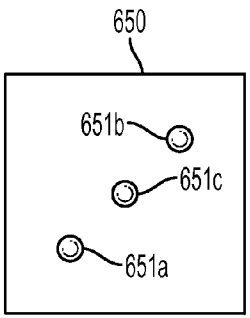
Figure 12F:
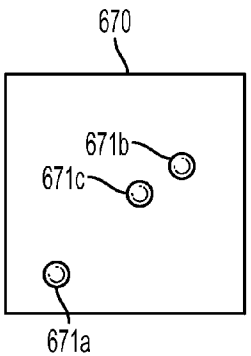

FIGS. 12A to 12C are diagrams illustrating alternative arrangements of electrical contacts for a power adapter. FIGS. 12D to 12F are diagrams of alternative arrangements of electrical contacts of electrical plugs configured to engage the electrical contacts of FIGS. 12A to 12C, respectively.

FIG. 12A shows two electrical contacts 622*a*, 622*b* at a surface 623 of a power adapter 620. For example, the electrical contacts 622*a*, 622*b* can be located in channels 624*a*, 624*b* defined in the surface 623. The electrical contact 622*a* has a first end 625 and a second end 626, and the electrical contact 622*b* has a first end 627 and a second end 628.

The electrical contacts 631*a*, 631*b* of a plug 630 (FIG. 12D) can engage the electrical contacts 622*a*, 622*b* in four different orientations. In each orientation, each electrical contacts 631*a*, 631*b* of the plug 630 engage diagonally opposite ends 625, 628 or diagonally opposite ends 626, 627 of the electrical contacts 622*a*, 622*b*. Thus an each electrical contact 631*a*, 631*b* can engage a different portion of an electrical contact 622*a*, 622*b* in different orientations.

The polarity of the electrical contacts 631*a*, 631*b* relative to the electrical contacts 622*a*, 622*b* is not maintained in all of the orientations. For example, in some orientations the electrical contact 631*a* engages the electrical contact 622*a*, and in other orientations the electrical contact 631*a* engages the electrical contact 622*b*.

In some instances, manufacturing of one electrical contact 622*a*, 622*b* that extends in a channel 624*a*, 624*b* may be easier and less expensive than manufacturing two distinct recesses with two separate electrical contacts. Similar to the arrangement of electrical contacts 430*a*-430*d* of FIG. 8A, the electrical contacts 622*a*, 622*b* engage electrical contacts of a plug in four orientations. Nevertheless, the manufacturing and wiring of the electrical contacts 622*a*, 622*b* is simplified because there are fewer electrical contacts and fewer connections between the electrical contacts.

FIG. 12B illustrates three electrical contacts 642*a*-642*c* at a surface 643 of a power adapter 640. Three electrical contacts 651*a*-651*c* of an electrical plug 650 (FIG. 12E) engage the electrical contacts 642*a*-642*c* in four different orientations. In each of the orientations, the electrical contacts 651*a*, 651*b* engage the electrical contacts 642*a*, 642*b*. Polarity is not maintained through all of the orientations. Nevertheless, in each of the orientations, the electrical contact 651*c* engages the electrical contact 642*c* so that a consistent connection is established.

FIG. 12C illustrates three electrical contacts 662*a*-662*c* at a surface 663 of a power adapter 660. The electrical contacts 662*a*-662*c* are arranged to allow connections with a plug 670 (FIG. 12F) in only two orientations. The electrical contact 662*a* includes a first end 664 and a second end 665. The electrical contact 662*b* includes a first end 668 and a second end 669.

The plug 670 includes electrical contacts 671*a*-671*c* that engage the electrical contacts 662*a*-662*c* in two orientations. Other orientations of the plug 670 relative to the electrical contacts 662*a*-662*c* are disallowed. Polarity of the connections is maintained for both orientations. For example, in each orientation, the electrical contact 671*a* engages the electrical contact 662*a*, the electrical contact 671*b* engages the electrical contact 662*b*, and the electrical contact 671*c* engages the electrical contact 662*c*.

In the first orientation, the electrical contact 671*a* engages the second end 665 of the electrical contact 662*a*, and the electrical contact 671*b* engages the first end 668 of the electrical contact 662*b*. In the second orientation, the plug 670 is rotated 90 degrees from the position of the plug 670 in the first orientation. In the second orientation, the electrical contact 671*a* engages the first end 664 of the electrical contact 662*a*, and the electrical contact 671*b* engages the second end 669 of the electrical contact 662*b*. Because the electrical contacts 662*a*, 662*b* have different sizes and are arranged at the surface 673 at different distances from the center of the surface 673, the electrical contacts 671*a*, 671*b* cannot engage the electrical contacts 662*a*, 662*b* in any other orientations.

FIG. 13A is perspective view of an electrical plug 700 with a rotatable face 708. FIGS. 13B to 13C are side cutaway views of the electrical plug 700 illustrating various orientations of the rotatable face 708.

The electrical plug 700 can include a body 702, electrical prongs 704*a*, 704*b*, electrical contacts 706*a*, 706*b* and a rotatable face 708. The rotatable face 708 can be coupled to the body 702, and can be rotatable relative to the body 702. The electrical prongs 704*a*, 704*b* can be coupled to the rotatable face 708 such that rotation of the rotatable face 708 causes the orientation of the electrical prongs to change relative to the body 702. For example, the rotatable face 708 can rotate in a plane parallel to a surface 703 of the body 702. Rotation of the rotatable face 708 causes the electrical prongs 704*a*, 704*b* to change orientation with respect to the body 702 while the electrical prongs 704*a*, 704*b* extend in a direction substantially perpendicular to the surface 703.

The electrical prongs 704*a*, 704*b* can be connected to the electrical contacts 706*a*, 760*b* by circuitry in the body 702. For example, wires 711 or other conductors in the body 702 can establish an electrically conductive connection between the rotatable face 708 and the electrical contacts 706*a*, 706*b*.

The rotatable face 708 can rotate, for example, up to 90 degrees, 180 degrees, 270 degrees, 360 degrees or more. In some implementations the rotatable face 708 moves between multiple rotational positions by rotating in two directions (e.g., clockwise and counterclockwise). FIG. 13B shows the connections between the electrical prongs 704*a*, 704*b* and the electrical contacts 760*a*, 760*b* with no rotation of the rotatable face 708 relative to the body 702. FIG. 13C illustrates a 90 degree rotation of the rotatable face 708 relative to the body 702. FIG. 13D illustrates a 180 degree rotation of the rotatable face 708 relative to the body 702.

In some implementations, the wires 711 twist or cross each other in the body 702. In other implementations, electrical contacts are included at the rotatable face 708, opposite the electrical prongs 704*a*, 704*b*. Electrical contacts of the rotatable face 708 may engage additional electrical contacts in the body 702 to establish an electrical connection without causing wires 711 to cross. For example, one contact can be located at a side edge of the rotatable face 708 and another contact can be located at a center surface of the rotatable face 708. The contacts can be maintained in engagement with corresponding contacts in the body 702 during rotation of the rotatable face 708 relative to the body 702.

The rotatable face 708 allows the orientation of the electrical prongs 704*a*, 704*b* to be changed without repositioning of the body 702 relative to a power adapter. Thus in some implementations, multiple rotational orientations of the body 702 relative to a power adapter along a particular axis may not be needed.

Figure 14A:
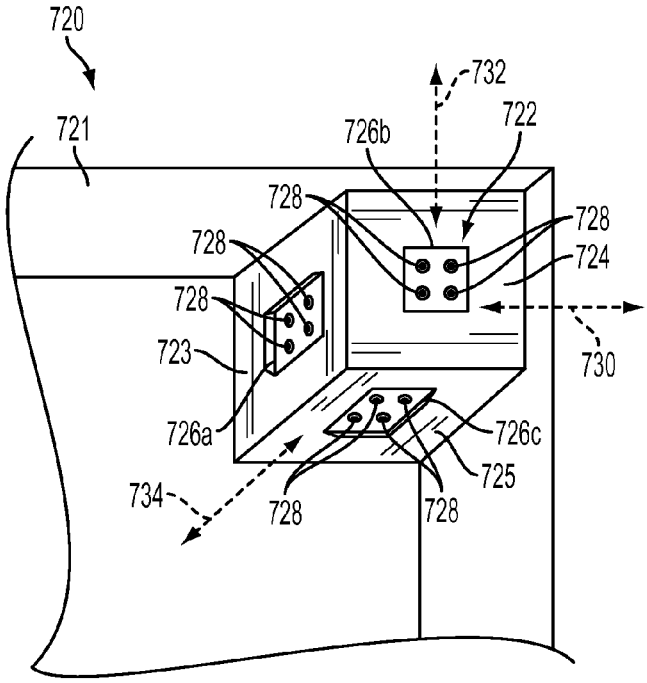
FIG. 14A is a perspective view of an alternative power adapter.
Figure 14B:
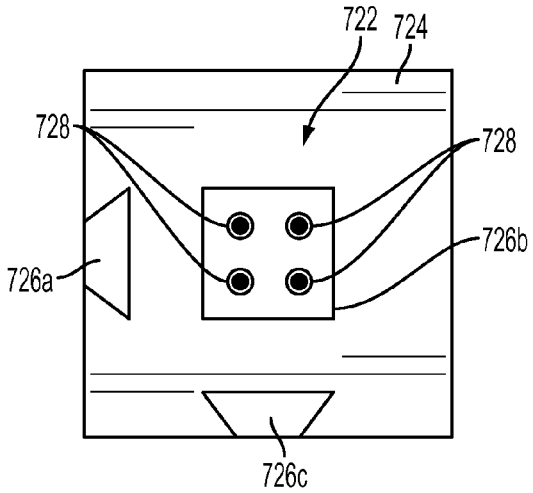
FIG. 14B is a side view of a receiving portion of the power adapter of FIG. 14A.

FIG. 14A is a perspective view of an alternative power adapter 720. FIG. 14B is a side view of a receiving portion 722 defined in the power adapter 720. In particular, FIG. 14B is a side view of a surface 724 from a perspective along an axis 734. The power adapter 720 includes posts 726*a*-726*c* can be used to secure an electrical plug 740 (FIGS. 14C and 14D) to the power adapter 720.

The power adapter 720 includes a housing 721, and the receiving portion 722 is defined at a corner of the housing 721. The housing 721 includes three mutually orthogonal surfaces 723, 724, 725 in the receiving portion 722. A post 726*a*-726*c* extends into the receiving portion 722 from each of the surfaces 723, 724, 725. The posts 726*a*-726*c* can have the shape of a truncated pyramid, such that each post 726*a*-726*c* has a trapezoidal cross-section. Alternatively, the posts 726*a*-726*c* can have the shape of a truncated cone, such that each post 726*a*-726*c* also has a trapezoidal cross-section. Posts 726*a*-726*c* of other shapes may also be used. In addition, electrical contacts 728 can be defined at or in the posts 726*a*-726*c*. In addition, or alternatively, electrical contacts 728 can be located at the surfaces 723, 724, 725.

Figure 14C:
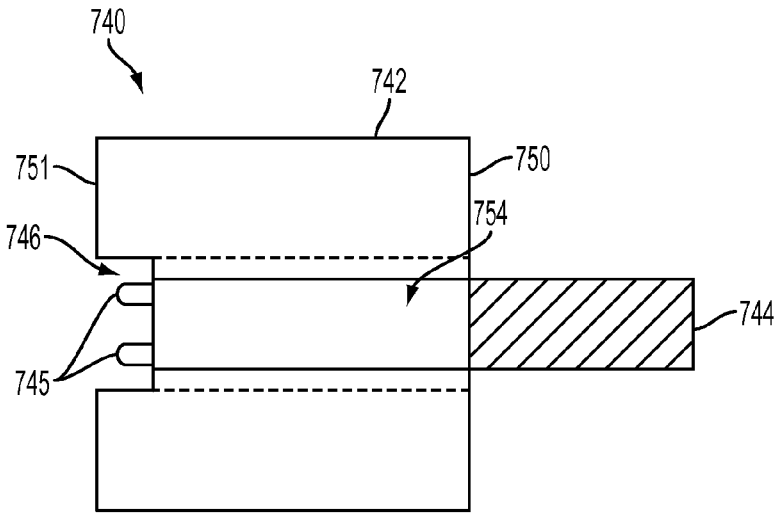
FIG. 14C is a side view of an electrical plug that can be coupled to the power adapter of FIG. 14A.
Figure 14D:
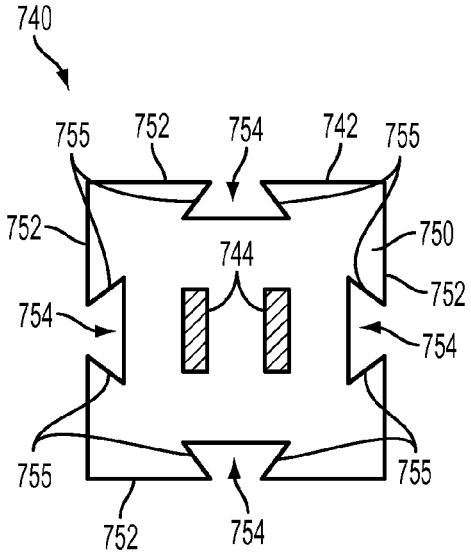
FIG. 14D is an end view of the electrical plug of FIG. 14C.

FIG. 14C is a side view of an electrical plug 740 that can be coupled to the power adapter 720. FIG. 14D is an end view of the electrical plug 740.

The electrical plug 740 includes a substantially cube-shaped body 742. The plug 740 includes electrical prongs 744 coupled to a first side 750 of the body 742, and electrical contacts 745 coupled to a second side 751 of the body 742. The body 742 can define a recess 746 in the second side 751 that receives one of the posts 726*a*-726*c*. In some implementations, the electrical contacts 745 can extend into the recess 746 or beyond the recess 746.

The body 742 includes four lateral sides 752, which are substantially orthogonal to the first side 750. A channel 754 is defined in each of the lateral sides 752. Each channel 754 can define a trapezoidal cross-section to allow a post 726*a*-726*c* to slide into the channel 754. For example each channel 754 can be defined by angled walls 755. Engagement of a post 726*a*-726*c* in a channel 754 restricts movement of the plug 740 relative to the power adapter 720 to secure the plug 740 to the power adapter 720.

The plug 740 can be secured to the power adapter 720 in twelve orientations. The plug 740 can be coupled to the power adapter 720 along one of three axes 730, 732, 734 that are substantially perpendicular to each other. Along each axis 730, 732, 734, the plug 740 can be coupled to the power adapter 720 in four orientations having different rotational offsets. In each of the twelve orientations, the electrical contacts 745 of the plug 740 engage one or more of the electrical contacts 728 of the power adapter 720.

For example, when the plug 740 enters the receiving portion 722 along the axis 734, the post 726*b* is received in the recess 746, the post 726*a* is received in one of the channels 754, and the post 726*c* is received in another of the channels 754. The engagement of the posts 726*a*, 726*c* in the channels 754 limits the motion of the plug 740 relative to the power adapter 720 so that the plug 740 can only be removed by motion along the axis 734.

Similarly, when the plug 740 enters the receiving portion 722 along the axis 732, the post 726*c* is received in the recess 746, the post 726*a* is received in one of the channels 754, and the post 726*b* is received in another of the channels 754. Finally, when the plug 740 enters the receiving portion 722 along the axis 730, the post 726*a* is received in the recess 746, the post 726*b* is received in one of the channels 754, and the post 726*c* is received in another of the channels 754.

Figure 15:
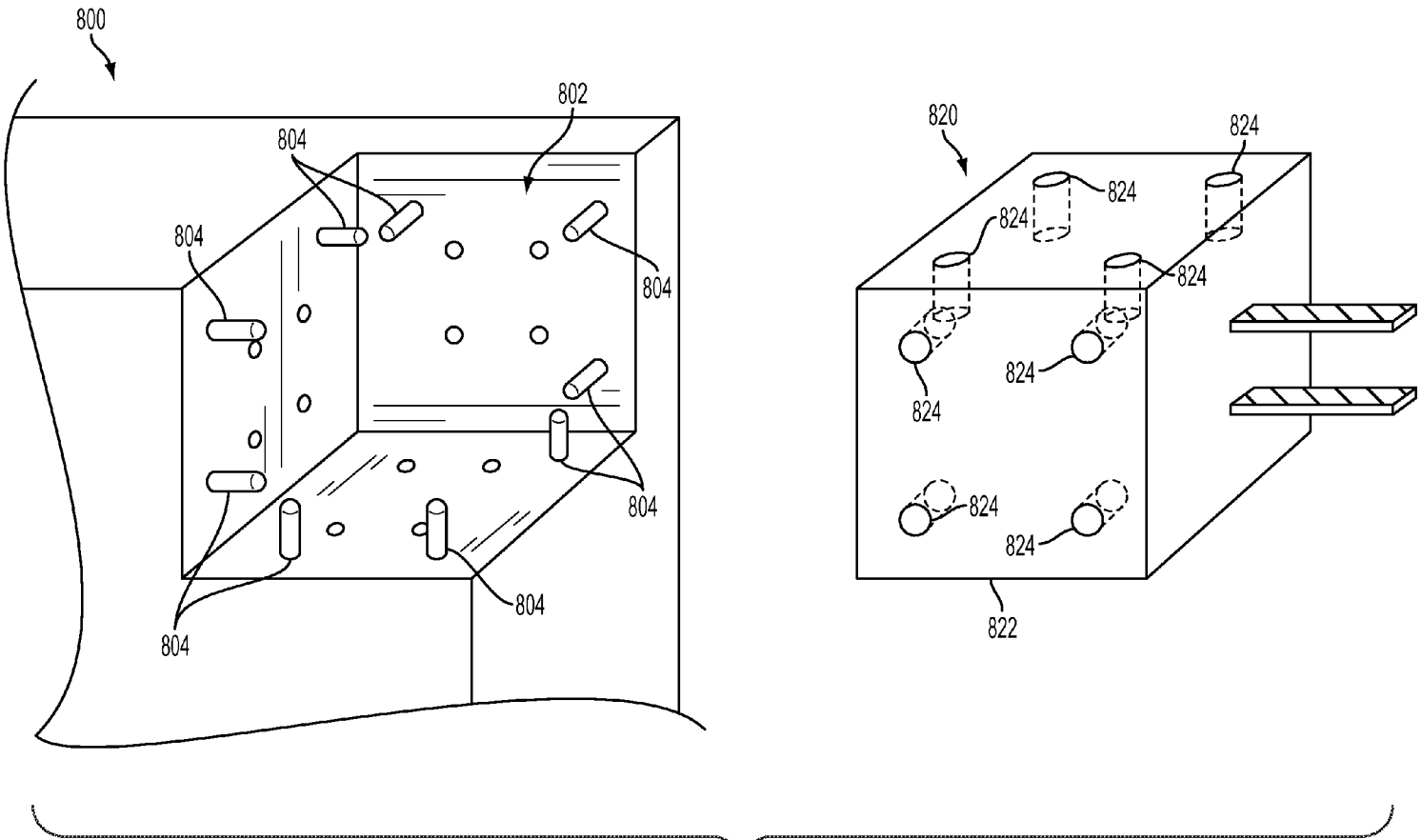
FIG. 15 is a perspective view of an alternative power adapter and an alternative plug.

FIG. 15 is a perspective view of an alternative power adapter 800 and an alternative plug 820.

The plug 820 includes a substantially cube-shaped body 822. One or more sides of the body 822 define one or more recesses 824. The recesses 824 can receive a protruding feature of the power adapter 800 to secure the plug 820 in position relative to the power adapter 800.

For example, the power adapter 800 can include a receiving portion 802. The power adapter 800 can include one or more extensions 804 that extend into the receiving portion 802. For example, the extensions 804 can be spring-loaded. The extensions 804 can recede into the power adapter 800 as the plug 820 enters the receiving portion 802. The extensions 804 can then extend into the recesses 824 of the plug 820 when the plug 820 is properly aligned in the receiving portion 802. The engagement of the extensions 804 in the recesses 824 can couple the plug 820 to the power adapter 800.

Particular implementations have been described. Other implementations are within the scope of the following claims. For example, the steps recited in the claims can be performed in a different order and still achieve desirable results.

What is claimed is:

1. An electrical adapter system comprising:

a housing comprising:

a receiving portion, the housing comprising first electrical contacts and second electrical contacts disposed at the receiving portion, and a first surface of the receiving portion and a second surface of the receiving portion, the second surface of the receiving portion being substantially orthogonal to the first surface of the receiving portion, wherein the first electrical contacts are disposed at the first surface of the receiving portion and the second electrical contacts are disposed at the second surface of the receiving portion; and a plug comprising a body, electrical prongs extending from a surface of the body, and electrical contacts coupled to the electrical prongs, the body of the plug being receivable by the receiving portion in at least two orientations such that in each of the at least two orientations, the electrical prongs extend outward from the housing, and one or more of the electrical contacts of the plug engage at least one of the first electrical contacts or at least one of the second electrical contacts.

2. The electrical adapter system of claim 1, wherein the first electrical contacts and the second electrical contacts include at least one shared electrical contact.

3. The electrical adapter system of claim 1, wherein:

the receiving portion is configured to receive the body of the plug in a first orientation such that the electrical prongs extend substantially parallel to a first axis oriented substantially perpendicular to the first surface of the housing, and one or more of the electrical contacts of the plug engage one or more of the first electrical contacts of the housing; and the receiving portion is configured to receive the body of the plug in a second orientation such that the electrical prongs extend substantially parallel to a second axis substantially perpendicular to the second surface of the housing and one or more of the electrical contacts of the plug engage one or more of the second electrical contacts of the housing.

4. The electrical adapter system of claim 3, wherein the receiving portion is configured to receive the body of the plug in a third orientation such that:

the electrical prongs extend substantially parallel to the first axis and one or more of the electrical contacts of the plug engage one or more of the first electrical contacts of the housing; and the orientation of the body of the plug relative to the housing is rotationally offset by approximately 90 degrees relative to the orientation of the body of the plug relative to the housing in the first orientation.

5. The electrical adapter system of claim 1, wherein the body is substantially cube-shaped and wherein the receiving portion is substantially cube-shaped.

6. The electrical adapter system of claim 1, wherein the receiving portion is located at a corner of the housing.

7. The electrical adapter system of claim 1, wherein the receiving portion is configured to receive the plug in at least four orientations, and in each of the at least four orientations, one or more of the electrical contacts of the plug engage at least one of the first electrical contacts or at least one of the second electrical contacts.

8. The electrical adapter system of claim 1, wherein the receiving portion is configured to receive the plug in at least eight orientations, and in each of the at least eight orientations, one or more of the electrical contacts of the plug engage at least one of the first electrical contacts or at least one of the second electrical contacts.

9. The electrical adapter system of claim 1, wherein the housing further comprises third electrical contacts disposed at the receiving portion, and wherein the body of the plug is receivable by the receiving portion in at least three orientations.

10. The electrical adapter system of claim 9, wherein:

the receiving portion is configured to receive the plug in a first orientation such that the electrical prongs extend in the direction of a first axis and one or more of the electrical contacts of the plug engage one or more of the first electrical contacts;

the receiving portion is configured to receive the plug in a second orientation such that the electrical prongs extend in the direction of a second axis, the second axis being orthogonal to the first axis, and one or more of the electrical contacts of the plug engage one or more of the second electrical contacts; and the receiving portion is configured to receive the plug in a third orientation such that the electrical prongs extend in the direction of a third axis, the third axis being orthogonal to both the first axis and the second axis, and one or more of the electrical contacts of the plug engage one or more of the third electrical contacts.

11. The electrical adapter system of claim 9, wherein the receiving portion is configured to receive the plug in at least six orientations such that in each of the at least six orientations, one or more of the electrical contacts of the plug engage at least one of the first electrical contacts, at least one of the second electrical contacts, or at least one of the third electrical contacts.

12. The electrical adapter system of claim 9, wherein the receiving portion is configured to receive the plug in at least twelve orientations such that in each of the at least twelve orientations, one or more of the electrical contacts of the plug engage at least one of the first electrical contacts, at least one of the second electrical contacts, or at least one of the third electrical contacts.

13. A power adapter comprising:

a housing comprising a receiving portion, the housing having a first surface disposed at the receiving portion and a second surface disposed at the receiving portion, the first surface being substantially orthogonal to the second surface;

first electrical contacts including at least one contact disposed at the first surface; and second electrical contacts including at least one contact disposed at the second surface, wherein the housing is configured to receive a body of a plug in the receiving portion in at least two orientations such that in each of the at least two orientations, an electrically conductive connection is established between the plug and at least one of the first electrical contacts or at least one of the second electrical contacts.

14. The power adapter of claim 13, wherein the first electrical contacts and the second electrical contacts include at least one shared electrical contact.

15. The power adapter of claim 13, wherein the first surface and the second surface extend inwardly from an exterior of the housing.

16. The power adapter of claim 13, further comprising adapter circuitry located in the housing, wherein the adapter circuitry is configured to receive electrical input from either or both of the first electrical contacts and the second electrical contacts, and wherein one or more of the first electrical contacts and one or more of the second electrical contacts are connected such that voltages applied to the first electrical contacts are transmitted to the second electrical contacts, and voltages applied to the second electrical contacts are transmitted to the first electrical contacts.

17. The power adapter of claim 13, wherein the first electrical contacts are recessed into the first surface and the second electrical contacts are recessed into the second surface.

18. The power adapter of claim 13, wherein the first electrical contacts protrude from the first surface and the second electrical contacts protrude from the second surface.

19. The power adapter of claim 13, wherein the receiving portion is cube-shaped and is defined at a corner of the housing.

20. The power adapter of claim 13, wherein:

the housing has a third surface disposed at the receiving portion, the third surface being substantially orthogonal to the first surface and the second surface;

the power adapter further comprises third electrical contacts disposed at the third surface; and the housing is configured to receive a body of a plug in the receiving portion in at least three orientations such that in each of the at least three orientations, an electrically conductive connection is established between the plug and at least one of the first electrical contacts, at least one of the second electrical contacts, or at least one of the third electrical contacts.

21. An electrical plug comprising:

a member having a first pair of substantially parallel sides, a second pair of substantially parallel sides, and a third pair of substantially parallel sides, the first, second, and third pairs of substantially parallel sides each being substantially orthogonal to the other two pairs of substantially parallel sides, and the first, second, and third pairs of substantially parallel sides each defining a portion of the outer surface of the member, the first pair of substantially parallel sides comprising a first side and a second side;

electrical prongs coupled to the first side; and electrical contacts disposed at the second side and extending outward from the second side, the electrical contacts being coupled to the electrical prongs.

22. The electrical plug of claim 21, wherein the member includes angled walls defining a channel in each of one or more sides orthogonal to the first side.

23. The electrical plug of claim 21, wherein the member defines one or more recesses in at least one of the second pair of substantially parallel sides or in at least one of the third pair of substantially parallel sides.

24. The electrical plug of claim 21, further comprising a rotatable member disposed at the first side, the rotatable member being configured to rotate relative to the member, the electrical prongs being coupled to the rotatable member.

25. The electrical plug of claim 21, further comprising a safety mechanism disposed between the electrical contacts and the electrical prongs.

* * * * *